US007039349B2

(12) United States Patent
Sohmiya et al.

(10) Patent No.: US 7,039,349 B2
(45) Date of Patent: May 2, 2006

(54) IMAGE FORMING APPARATUS TRANSFERRING TONER IMAGES TO BOTH SURFACES OF A RECORDING MEDIUM

(75) Inventors: Norimasa Sohmiya, Saitama (JP); Chiemi Kaneko, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 179 days.

(21) Appl. No.: 10/697,119

(22) Filed: Oct. 31, 2003

(65) Prior Publication Data

US 2004/0141776 A1 Jul. 22, 2004

(30) Foreign Application Priority Data

Oct. 31, 2002 (JP) ..... 2002-317947
Mar. 20, 2003 (JP) ..... 2003-077855
Jun. 3, 2003 (JP) ..... 2003-158517

(51) Int. Cl.
*G03G 15/20* (2006.01)

(52) U.S. Cl. ..... 399/309; 399/306

(58) Field of Classification Search ..... 399/66, 399/299, 302, 306, 309, 364, 374; 355/24
See application file for complete search history.

(56) References Cited

U.S. PATENT DOCUMENTS 4,032,463 A 6/1977 Kawanishi et al.
4,538,901 A 9/1985 Soumiya
4,962,394 A 10/1990 Sohmiya et al.
5,006,896 A 4/1991 Koichi et al.
5,038,175 A 8/1991 Sohmiya et al.
5,394,231 A 2/1995 Sudo et al.
5,499,078 A 3/1996 Kurokawa et al.
5,559,590 A 9/1996 Arai et al.
5,570,162 A 10/1996 Sohmiya
5,619,311 A 4/1997 Kurokawa et al.
5,797,077 A * 8/1998 Samizo et al. ..... 399/309
6,173,148 B1 1/2001 Matsuda et al.
6,347,214 B1 2/2002 Kaneko (Continued)

FOREIGN PATENT DOCUMENTS

JP 3-253881 11/1991
JP 2000-105513 4/2000

(Continued)

OTHER PUBLICATIONS

U.S. Appl. No. 10/161,742, filed Jun. 5, 2002, Mochimaru et al.
U.S. Appl. No. 10/176,672, filed Jun. 24, 2002, Omata et al.
U.S. Appl. No. 10/252,104, filed Sep. 23, 2002, Mochimaru et al.

(Continued)

*Primary Examiner*—Robert Beatty
(74) *Attorney, Agent, or Firm*—Oblon, Spivak, McClelland, Maier & Neustadt, P.C.

(57) ABSTRACT

An image forming apparatus operable in a duplex print mode includes an image carrier and an image transferring device including a first and a second intermediate image transfer body whose surfaces are movable in contact with each other while forming a nip therebetween. Toner images are respectively transferred to opposite surfaces of a sheet using two pairs of conductive rollers that face each other via the first and second intermediate image transfer bodies at a nip. Two of the conductive rollers associated with the second intermediate image transfer body are transfer rollers respectively applied with one and the other of biases of opposite polarities.

96 Claims, 10 Drawing Sheets

U.S. PATENT DOCUMENTS

| | | | | |
|---|---|---|---|---|
| 6,556,804 | B1 * | 4/2003 | Lobel et al. | 399/306 |
| 6,574,448 | B1 | 6/2003 | Mochimaru et al. | |
| 6,643,489 | B1 | 11/2003 | Omata et al. | |
| 6,801,742 | B1 * | 10/2004 | Mochimaru et al. | 399/309 |
| 2002/0015602 | A1 * | 2/2002 | Mochimaru et al. | 399/309 |

FOREIGN PATENT DOCUMENTS

JP 2001331046 A * 11/2001

JP 2002040720 A * 2/2002

OTHER PUBLICATIONS

U.S. Appl. No. 10/321,455, filed Dec. 18, 2002, Omata et al.
U.S. Appl. No. 10/310,892, filed Dec. 6, 2002, Omata et al.
U.S. Appl. No. 10/424,077, filed Apr. 28, 2003, Suzuki et al.
U.S. Appl. No. 10/697,119, filed Oct. 31, 2003, Sohmiya et al.

* cited by examiner

IMAGE FORMING APPARATUS TRANSFERRING TONER IMAGES TO BOTH SURFACES OF A RECORDING MEDIUM

BACKGROUND OF THE INVENTION

1. Field of the Invention

The present invention relates to a copier, facsimile apparatus, printer or similar image forming apparatus and more particularly to an image forming apparatus of the type transferring toner images to both surfaces of a recording medium with a so-called one-pass type of image transfer system.

2. Description of the Background Art

An image forming apparatus configured to transfer images to both surfaces of a sheet or similar recording medium is conventional and uses either one of two different image transfer systems, i.e., a switchback system and a one-pass system. The switchback system conveys a sheet via image transferring means to thereby transfer a toner image from a photoconductive drum or similar image carrier to one surface of the sheet, switches back the sheet, and then transfers another toner image to the other surface of the sheet. On the other hand, the one-pass system transfers toner images to both sides of a sheet with image transferring means substantially at the same time without switching back the sheet. The one-pass system is advantageous over the switchback system in that it is free from an increase in cost and an increase in image forming time ascribable to a sophisticated switchback mechanism.

An image forming apparatus using the one-pass system stated above is disclosed in, e.g., Japanese Patent No. 2,906,538 and Japanese Patent Laid-Open Publication No. 2000-105513. The apparatus taught in U.S. Patent No. 2,906,538 includes switching means for switching the polarity of a second toner image developed on a photoconductive element and passes a sheet between the photoconductive element and an intermediate image transfer body to thereby form toner images on both sides of the sheet at the same time. On the other hand, the apparatus taught in Laid-Open Publication No. 2000-105513 includes two developing units each for developing a latent image with a developer of particular polarity and transfers toner images formed by the two developing units to both sides of a sheet.

A conventional one-pass type of image forming apparatus includes a first and a second intermediate image transfer belt, as will be described specifically later with reference to FIG. 1. Toner images of different colors formed on, e.g., photoconductive drums are sequentially transferred to the first intermediate image transfer belt one above the other, completing a color image. The color image is then transferred to the second intermediate image transfer belt. A charger or tertiary image transferring means adjoins the second intermediate image transfer belt for transferring the toner image from the belt to a sheet.

In the one-pass type of apparatus stated above, the image carried on the second intermediate image transfer belt, but not transferred to a sheet, is conveyed to a nip between the belt and the tertiary image transferring means. In addition, the image transferred to the sheet, but not fixed, is also conveyed to the above nip. Therefore, the tertiary image transferring means should not be implemented by a transfer roller contacting the second intermediate image transfer belt, but should be implemented by a charger not contacting the belt.

The problem with a charger is that it produces ozone and other toxic discharge products during operation. Further, in the above conventional apparatus, tertiary image transfer is effected with toner existing on a sheet with the result that the toner is scattered in accordance with the electric field of discharge and contaminates the charger.

In the apparatus disclosed in U.S. Pat. No. 2,906,538 or Laid-Open Publication No. 2000-105513 mentioned earlier, it is possible to obviate discharge products and toner scattering ascribable to a charger by omitting the tertiary image transferring means. However, switching the polarity of a toner image formed on a photoconductive element as in U.S. Pat. No. 2,906,538 or using two developing units as in Laid-Open Publication No. 2000-105513 results in a sophisticated configuration and an increase in cost. In this respect, neither one of such prior art technologies is a drastic solution to the problems particular to a charger.

Further, the polarity switching means proposed by U.S. Pat. No. 2,906,538 is implemented by a corona charger that also produces ozone and other toxic discharge products.

Technologies relating to the present invention are also disclosed in, e.g., Japanese Patent Laid-Open Publication No. 3-253881.

SUMMARY OF THE INVENTION

It is an object of the present invention to provide a one-pass type of image forming apparatus capable of obviating discharge products and toner scattering ascribable to discharge with a simple configuration without increasing cost.

An image forming apparatus capable of forming images on both surfaces of a recording medium of the present invention includes an image carrier and an image transferring device including a first and a second intermediate image transfer body whose surfaces are endlessly movable in contact with each other while forming a nip therebetween. The image transferring device transfers, while conveying the recording medium nipped by the nip toward a side downstream of the nip in a direction in which the above surfaces are endlessly movable, a first toner image transferred from the image carrier to the second intermediate image transfer body via the first intermediate image transfer body beforehand to the first surface of the recording medium and transfers a second toner image transferred from the image carrier to the first intermediate image transfer body to the second surface of the recording medium. First- and second-surface image transferring means for respectively transferring the first and second toner images to the first and second surfaces of the recording medium, respectively, comprise two pairs of conductive rollers that face each other via the surfaces of the first and second intermediate image transfer bodies at the nip. Two of the conductive rollers associated with the second intermediate image transfer body comprise transfer rollers respectively applied with one and the other of biases of opposite polarities.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
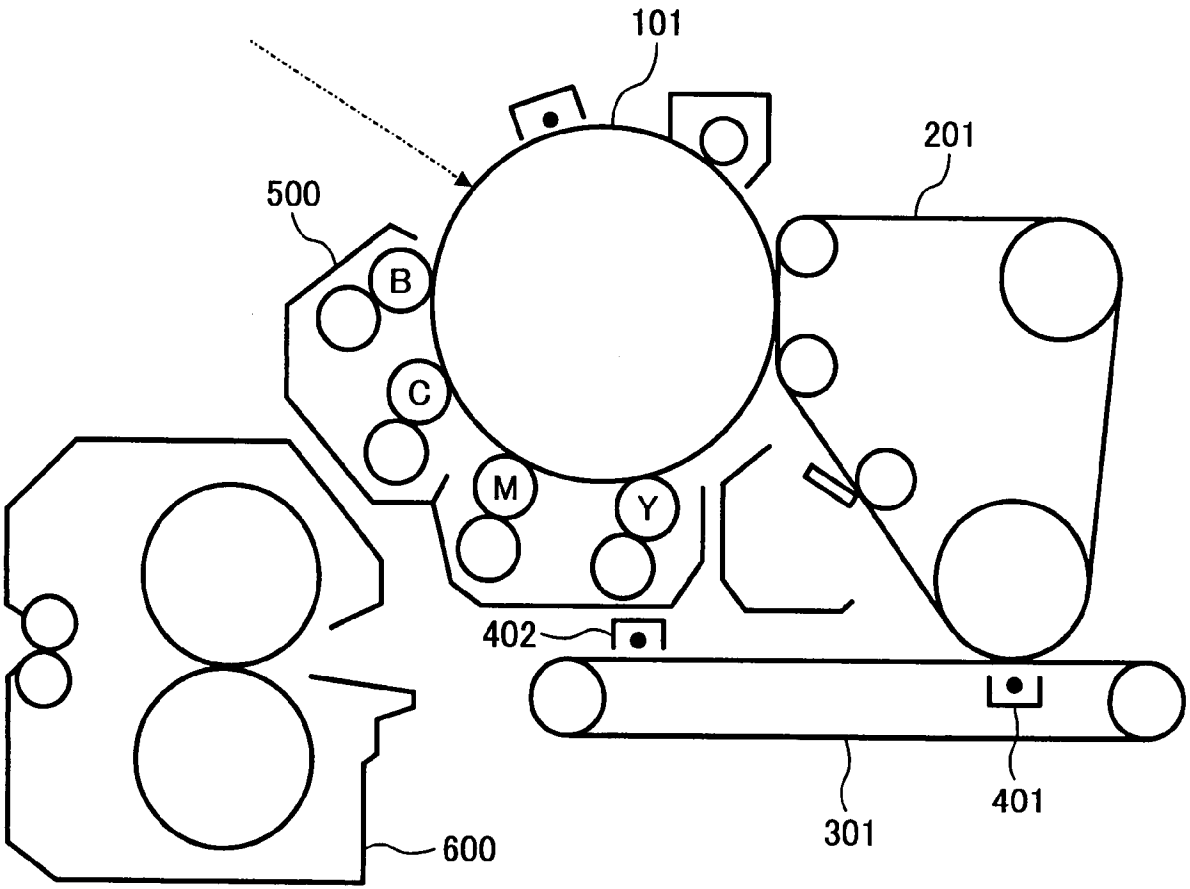
FIG. 1 PRIOR ART
FIG. 1 is a view showing a specific configuration of a conventional one-pass type of image forming apparatus.

To better understand the present invention, brief reference will be made to a conventional one-pass type of image forming apparatus, shown in FIG. 1. As shown, the image forming apparatus includes a photoconductive drum 101, which is a specific form of an image carrier. In a duplex print mode, a toner image to be transferred to the reverse surface of a sheet is formed on the drum 101 and then transferred to a second intermediate image transfer belt 301 via a first intermediate image transfer belt 201. The second intermediate image transfer belt 301, carrying the toner image thereon, is then caused to make one turn. On the other hand, a toner image to be transferred to the front surface of a sheet is formed on the drum 101 and then transferred to the first intermediate image transfer belt 201. A registration roller pair, not shown, conveys a sheet to a nip between the two belts 201 and 301 at such timing that the toner images carried on the belts 201 and 301 face each other at the above nip. Consequently, the toner images on the belts 201 and 301 are transferred to both surfaces of the sheet.

More specifically, the transfer of the toner image from the first intermediate image transfer belt 201 to the second intermediate image transfer belt 301 and the transfer of the toner image from the belt 201 to the upper surface of a sheet are effected by a transfer charger or secondary image transferring means 401, which is disposed inside the loop of the belt 301. On the other hand, the transfer of the toner image from the second intermediate image transfer belt 301 to the lower surface of the sheet is effected by a transfer charger or tertiary image transferring means 402, which is disposed outside the loop of the belt 301. With this configuration, the apparatus is capable of transferring toner images to both surfaces of a sheet by passing the sheet only one time.

In FIG. 1, there are also shown a developing unit 500 and a fixing unit 600.

The problem with the apparatus described above is that the transfer charger or tertiary image transferring means 402 produces discharge products and causes toner to be scattered, as stated earlier.

Preferred embodiments of the image forming apparatus in accordance with the present invention will be described hereinafter.

First Embodiment

Figure 2:
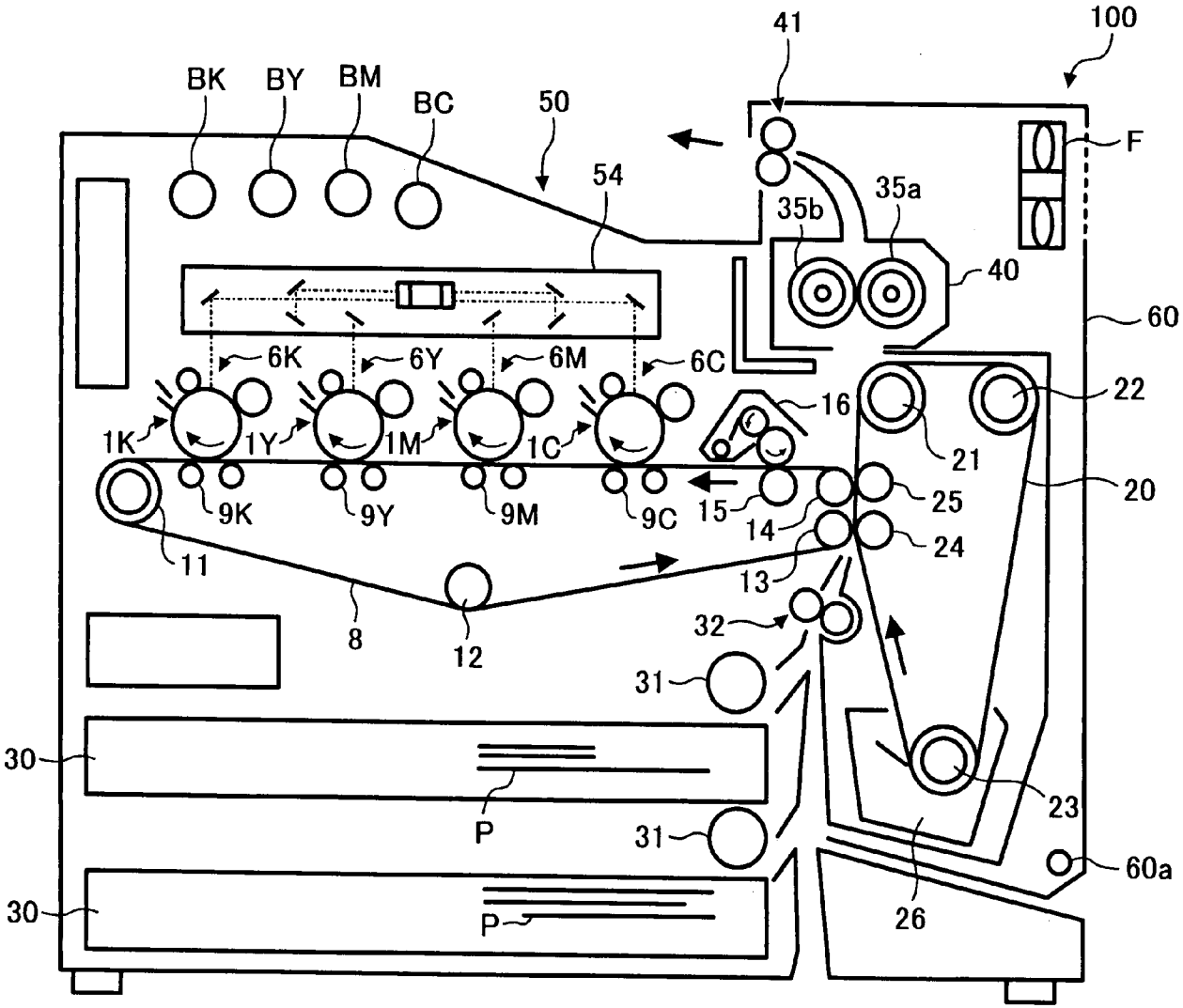
FIG. 2 is a view showing a first embodiment of the image forming apparatus in accordance with the present invention.
Figure 3:
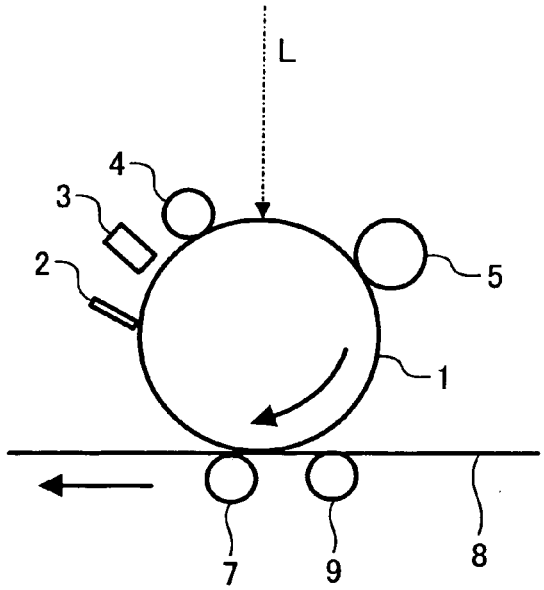
FIG. 3 is a fragmentary view showing one of a plurality of photoconductive drums included in the first embodiment together with arrangements surrounding it.

Referring to FIG. 2, an image forming apparatus embodying the present invention is shown and implemented as a tandem color printer by way of example. As shown, the color printer, generally 100, includes four photoconductive drums 1Y (yellow), 1M (magenta), 1C (cyan) and 1K (black) arranged side by side in substantially the center portion of the apparatus. As shown in FIG. 3, a cleaner 2, a quenching lamp or discharger 3, a charger 4 and a developing device 5 are arranged around each drum, labeled 1, constituting an image forming unit. Such four image forming units are identical in configuration except for the color of toner to use.

As shown in FIG. 2, a first intermediate image transfer belt or body (simply first belt hereinafter) 8 is positioned below the four image forming units. The drums 1C through 1K are arranged along and held in contact with the upper run of the first belt 8, as illustrated. An exposing unit 54 is positioned above the image forming units.

The developing device 5, FIG. 3, stores one of cyan toner, magenta toner, yellow toner and black toner and deposits the toner on a latent image formed on associated one of the drums 1C through 1K. A laser beam L, issuing from the exposing unit 54 in accordance with image data, scans the drum 1 at a position between the charger 4 and the developing device 5. While the exposing unit 54 uses a laser, it may be replaced with an exposing unit using an LED (Light Emitting Element) array and focusing means, if desired.

Primary transfer rollers or primary image transferring means 9C through 9K respectively face the drums 1C through 1K with the intermediary of the first belt 8. As shown in FIG. 3, a backup roller 7 adjoins each primary transfer roller 9. A toner image formed on each drum 1 is transferred to the first belt 8 by associated one of the primary transfer rollers 9C through 9K.

In a full-color mode, a cyan, a magenta, a yellow and a black toner image formed on the drums 1C through 1K, respectively, are sequentially transferred to the first belt 8 one above the other, completing a full-color image. In a monochrome mode, only the image forming unit storing black toner is operated to form a monochromatic toner image. The monochromatic toner image is then transferred to the first belt 8.

The first belt 8 is passed over four rollers 11, 12, 13 and 14 and movable counterclockwise, as viewed in FIG. 2, as indicated by an arrow. A backup roller 15 is positioned at the left-hand side of the roller 14 within the loop of the first belt 8. A belt cleaner 16 faces the backup roller 15 at the outside of the loop of the first belt 8.

Two sheet cassettes or sheet feeding devices 30 are positioned one above the other in the lower portion of the printer body. A sheet P, positioned on the top of a sheet stack, is paid out from either one of the sheet cassettes 30 by a pickup roller 31 and conveyed to a registration roller pair 32.

A second intermediate image transfer belt (simply second belt hereinafter) 20 is positioned at the right-hand side of the first belt 8 and passed over rollers 21, 22, 23, 24 and 25 in such a manner as to be movable clockwise, as viewed in FIG. 2. In the illustrative embodiment, the rollers 24 and 25 are respectively implemented as a first- and a second-surface transfer roller or second-surface and first-surface image transferring means. The second-surface transfer roller 24 faces the roller 13 of the first belt 8 while the first-surface transfer roller 25 faces the roller 14 of the belt 8.

The first and second belts 8 and 20 contact each other over a zone where they are passed over the rollers 13 and 14 and rollers 24 and 25, respectively, forming a nip for image transfer. In the illustrative embodiment, the second belt 20 is angularly movable about the axis of the roller 21 into or out of contact with the first belt 8, as needed. This is effected by, e.g., a spring and solenoid mechanism not shown.

A belt cleaner 26 is positioned below and outside the loop of the second belt 20. The belt cleaner 26 is configured to wipe off unnecessary toner and paper dust deposited on the second belt 20 with a cleaning blade.

A fixing unit 40 is positioned above the second belt 20 and includes a fixing roller 35*a* and a pressing roller 35*b* each of which is heated by a heater. A sheet, coming out of the fixing unit 40, is driven out to a stack tray 50 by an outlet roller pair 41.

Figure 5:
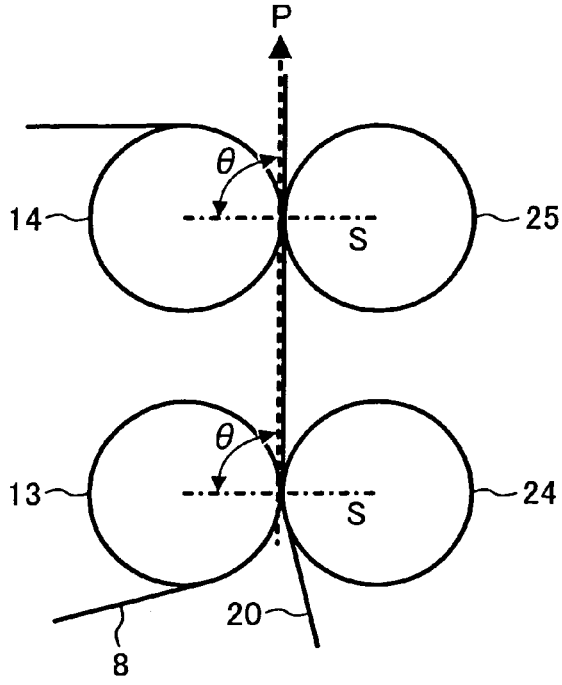
FIG. 5 is an enlarged view showing part of a second embodiment of the present invention.

The image transferring means included in the printer 100 will be summarized hereinafter. First, the transfer rollers 9 (9C through 9K) transfer toner images from the associated drums 1 to the first belt 8. Second, as shown in FIG. 5, the second-surface transfer roller 24 and roller 13, which faces the roller 24 via the first and second belts 8 and 20, constitute the second-surface image transferring means for transferring the toner image from the first belt 8 to either one of the second belt 20 and the second or reverse surface of a sheet. Third, the first-surface transfer roller 25 and roller 14, which faces the roller 24 via the first and second belts 8 and 20, constitute the first-surface image transferring means for transferring the toner image from the second belt 20 to the first or front surface of a sheet, e.g., effecting tertiary image transfer. The rollers 13, 14, 24 and 25 are electrically conductive.

In the illustrative embodiment, the circumference of the transfer roller 24 and that of the transfer roller 25 are spaced from each other by a distance of 20 mm at a position where they are closest to each other although such a distance is open to choice. While the illustrative embodiment uses a constant-current type of bias control system for image transfer, use may alternatively be made of a differential constant-current or constant-voltage or a constant voltage plus constant current type of bias control system, if desired.

In the illustrative embodiment, among the rollers disposed in the loops of the first and second belts 8 and 20, the rollers other than the rollers 9, 24 and 25 are grounded. In this condition, the rollers 13 and 14, respectively facing the transfer rollers 24 and 25, play the role of ground rollers. However, the roller 14, positioned at the downstream side of the nip, does not have to be grounded in the event of transfer of the first toner image from the first belt 8 to the second belt 20.

In the illustrative embodiment, each drum or image carrier 1 consists of a hollow cylindrical drum formed of aluminum and having a diameter of 30 mm to 100 mm and an organic, photoconductive semiconductor layer formed on the drum. The first and second belts 8 and 20 each include a 50 μm to 600 μm thick base formed of resin or rubber. The belts 8 and 20 each are provided with resistance that allows toner to be transferred thereto. It is therefore preferable to provide each of the first and second belts 8 and 20 with medium resistance between $10^7$ Ω/□ and $10^{10}$ Ω/□. In the illustrative embodiment, the belts 8 and 20 each are provided with resistance of $10^9$ Ω/□.

In operation, in a duplex print mode, a first toner image to be transferred to the first or front surface of a sheet is formed by the four image transferring units and then transferred to the second belt 20 via the first belt 8. The second belt 20, thus carrying the first toner image, is caused to make one turn. At this instant, a second toner image to be transferred to the second or reverse surface of the same sheet is formed by the image forming units and then transferred to the first belt 8. Of course, the first and second toner images are formed at such timing that they are located at a preselected position on the sheet.

The second-surface toner image is transferred from the first belt 8 to the second surface of a sheet fed from the registration roller pair 32 by the second-surface transfer roller 24; the second surface is the left surface of a sheet being conveyed upward in FIG. 2. The first-surface toner image, moved by one turn of the second belt 20, is transferred to the first surface of the sheet by the first-surface transfer roller 25; the first surface is the right surface of the sheet being conveyed upward in FIG. 2. The sheet, carrying the two toner images on both surfaces thereof, is conveyed to the fixing unit 40, so that the two toner images are fixed on the sheet by the fixing roller and pressing roller mentioned earlier.

In the illustrative embodiment, the sheet is driven out to the stack tray 40 with the second-surface toner image formed later, i.e., the toner image directly transferred from the belt 8 to the sheet facing downward. Therefore, to stack sheets or prints on the stack tray 50 in order of page, it suffices to form the second-surface image before the first-surface image.

Exposure is effected such that the image is transferred from the first belt 8 to the sheet as a non-inverted or non-mirror image while the image is transferred from the belt 20 to the sheet as an inverted or mirror image.

The image forming order described above can be implemented by a conventional technology that stores image data in a memory. Also, the switching of a non-inverted image and an inverted image can be effected by any one of conventional image processing technologies.

In a simplex print mode, a toner image formed by the image forming units is directly transferred from the first belt 8 to a sheet without the intermediary of the second belt 20. In this case, toner images should only be formed in order of page.

A sheet or print, carrying an image only on one surface thereof, can be driven out face up if transferred to the sheet by way of the second belt 20. In this case, to stack consecutive prints in order of page, a succeeding page is formed first.

In the illustrative embodiment, toner of negative polarity is deposited on each drum 1. The resulting first toner image is transferred to the first belt 8 by the transfer roller 9 to which a charge of positive polarity is applied. The first toner image is then transferred, or electrostatically attracted, from the first belt 8 to the second belt 20 by the second-surface transfer roller 24 to which +20 μA, also opposite in polarity to the toner, is applied. Subsequently, the second toner image transferred to the first belt 8 is also transferred, or electrostatically attracted, to the second surface of the sheet by the second-surface transfer roller 24 to which +50 μA, also opposite in polarity to the toner, is applied. The first toner image carried on the second belt 20 is then transferred, or electrostatically forced out, to the first surface of the sheet by the first-surface transfer roller 25 to which −20 μA, identical in polarity with the toner, is applied.

It was experimentally found that the sheet, carrying the toner images on both surfaces thereof, was stably conveyed to the fixing unit 40 by the second belt 20 and that the toner images were of high quality.

In the illustrative embodiment, the first-surface transfer roller 25 plays the role of the transfer charger or tertiary image transferring means 402, FIG. 1, conventionally positioned outside the loop of the second belt 20. The first-surface transfer roller 25 therefore serves as contact type of image transferring means. It follows that all image transferring means included in the illustrative embodiment can be implemented as contact type of image transferring means that produce no discharge products. Further, the toner deposited on the second belt 20 or the toner transferred to a sheet are not scattered around, so that various members around the belt 20 are free from contamination.

Further, the first- and second-surface transfer rollers 25 and 24 both are disposed inside the loop of the second belt 20, so that only the second belt 20 should be provided with preselected conditions. This successfully reduces cost, compared to the case wherein the belts 8 and 20 both should be provided with preselected conditions.

A conveying unit 60, including the second belt 20, is openable about a fulcrum 60*a* away from the printer body. Therefore, the two transfer rollers 24 and 25 both of which are associated with the second belt 20 can be easily maintained.

Moreover, the illustrative embodiment does not need a mechanism for switching the polarity of toner images and other additional mechanisms and is therefore simple and low cost. In addition, the second belt 20, moved away from the nip toward the downstream side, extends straight to the fixing unit 40 and can therefore desirably convey a sheet to a nip for fixation.

Assume that the biases applied to the second-surface or upstream transfer roller 24 and first-surface or downstream transfer roller 25 are a and b, respectively. Then, in the illustrative embodiment, the biases a and b are respectively +50 μA, opposite in polarity to the toner, and −20 μA identical in polarity with the toner, as stated earlier. The biases a and b are therefore related as:

$$a+b\neq 0$$

The amount of charge, deposited on a sheet by the ozone-less image transfer system as in the illustrative embodiment, varies in accordance with the currents and polarities thereof applied to the transfer rollers 24 and 25, as determined by experiments. More specifically, when currents of the same absolute value, but opposite in polarity, and 0 μA when added together, e.g., +20 μA and −20 μA were respectively applied to the transfer rollers 24 and 25, the amount of charge deposited on a sheet was measured to be around zero. Such an amount of charge reduces adhesion between a sheet and the second belt 20, so that the belt 20 is apt to fail to stably convey a sheet. This is particularly true when a sheet is conveyed upward as in the illustrative embodiment.

By contrast, in the illustrative embodiment, the sum of currents applied to the transfer rollers 24 and 25 is +30 A and therefore charges a sheet being conveyed via the nip to a certain degree. This allows a sheet to closely adhere to the belts 8 and 20 each having medium resistance.

To make sheet conveyance more stable, a sheet should preferably be charged to opposite polarity to the toner; otherwise, toner scattering and other defects are apt to occur. In the illustrative embodiment, the positive current a applied to the second-surface transfer roller 24 and opposite in polarity to the toner is provided with a greater absolute value than the current b applied to the second-surface transfer roller 25:

$$|a|>|b|$$

With the above relation, it is possible to charge a sheet to positive polarity opposite to the polarity of the toner for thereby insuring stable image transfer and sheet conveyance.

Now, the amount of charge to deposit on a sheet depends on the resistance of the sheet. Therefore, to insure stable sheet conveyance and image transfer, it is necessary to apply a current matching with the kind of a sheet. Hereinafter will be described a specific modification of the illustrative embodiment configured to apply a current matching with the kind of a sheet.

In the modification, the bias a applied to the second-surface transfer roller 24 and opposite in polarity to the toner is varied in accordance with the kind of a sheet. In the modification, the kind of a sheet is the thickness of a sheet. A mode select button, not shown, is provided on the printer for allowing the operator to input the thickness of a sheet to use, so that the value of the bias a can be varied in accordance the thickness of the sheet.

Assume that a thick sheet is used. Positive charges opposite in polarity to the toner are applied to the transfer rollers 9, transferring toner images from the drums 1 to the first belt 8 one above the other. The resulting first color toner image is transferred, or electrostatically attracted, from the first belt 8 to the second belt 20 by the second-surface transfer roller 24 to which +20 μA, opposite in polarity to the toner, is applied. Subsequently, a second color toner image formed on the first belt 8 is transferred to the second surface of a sheet by the second-surface transfer roller 24 to which +60 μA, opposite in polarity to the toner, is applied. Thereafter, −20 A, identical in polarity with the toner, is applied to the first-surface transfer roller 25 to thereby transfer, or force out, the first toner image from the second belt 20 to the first surface of the sheet. The sheet or print is then stably conveyed via the fixing unit 40 with the toner images being desirably fixed on both surfaces of the sheet, as determined by experiments.

As stated above, while the illustrative embodiment applies a current a of +50 μA to the second-surface transfer roller 24 when a sheet of ordinary thickness is used, the modification applies a current of +60 μA to the roller 24 when a thick sheet is used. In this manner, although a thick sheet is more difficult to charge than a sheet of ordinary thickness, it is possible to free a thick sheet from short charge by increasing the current to be applied to the roller 24. When use is made of a thick sheet, the current to be applied to the roller 24 may be lowered.

While the kind of a sheet is determined in terms of thickness in the above modification, it may, of course, be replaced with the material or similar factor of a sheet so long as it effects the resistance of a sheet.

In the illustrative embodiment, the rollers 13 and 14, respectively facing the first- and -second surface transfer rollers 24 and 25 are implemented as ground rollers, as stated previously. In this configuration, when biases are applied to the transfer rollers 24 and 25, currents flow between the transfer rollers 24 and 25 and the rollers 13 and 14, respectively, forming stable electric fields for image transfer. The ground rollers 13 and 14 may be replaced with electrode rollers, if desired. The crux is that so long as the rollers 13 and 14 are not in a floating state, image transfer stable to a certain degree is achievable.

As stated above, the illustrative embodiment is capable of obviating discharge products and toner scattering ascribable to discharge with a simple, lost cost configuration. Further, the first- and second-surface transfer rollers 24 and 25 both are associated with the second intermediate image transfer body 20, so that only the second intermediate transfer body 20 should be provided with preselected conditions, successfully reducing cost.

Second Embodiment

The first embodiment described above applies charges opposite in polarity to the toner to the transfer rollers or image transferring means 14 and 24, thereby transferring a toner image by electrostatic attraction. A second embodiment to be described hereinafter applies charge of the same polarity as the toner to the above image transferring means. Because the second embodiment is identical with the first embodiment as to the construction of the printer, the following description will concentrate on arrangements unique to the second embodiment.

In the illustrative embodiment, the transfer roller 14 associated with the first belt 8 is used as the secondary image transferring means for transferring a toner image from the first belt 8 to either one of the second belt 20 and the front surface of a sheet. More specifically, a charge of the same polarity as the toner is applied to the transfer roller 14, causing the toner image to be transferred to the second belt 20 by repulsion. In this case, the roller 25 facing the transfer roller 14 serves as a ground roller.

The transfer roller 24 associated with the second belt 20 is used as the tertiary image transferring means for transferring a toner image from the second belt 20 to the reverse surface of a sheet. More specifically, a charge of the same polarity as the toner is applied to the transfer roller 24, again causing the toner image to be transferred to a sheet by repulsion. The roller 13 facing the transfer roller 24 serves as a ground roller.

In the illustrative embodiment, too, the rollers 13 and 14 may be respectively implemented as the secondary and tertiary image transferring means while the transfer rollers 24 and 25 may be implemented as ground rollers.

Repulsion image transfer unique to the illustrative embodiment as stated above is capable of transferring toner images more efficiently than attraction image transfer. Of course, the illustrative embodiment achieves the same advantages as the first embodiment because the first to third image transferring means all can be implemented as contact type of image transferring means. In addition, the illustrative embodiment protects the image transferring means from damage in the event of jam processing.

In the first and second embodiments described above, the secondary and tertiary image transfer rollers 14 and 24 or 13 and 25 disposed in the loops of the first and second belts 8 an 20, respectively, are shifted in position from each other, in the up-and-down direction in the illustrative embodiment. This prevents the resulting electric fields for image transfer from interfering with each other. To obviate interference more positively, the distance between the circumferential surfaces of the transfer roller 14 and 24 or 13 and 25 should be 5 mm or above, preferably 10 mm or above.

The secondary and tertiary image transfer rollers 14 and 24 or 13 and 25 are formed of metal, resin or rubber and should preferably be provided with resistance as low as $10^9$ Ω·cm or below, more preferably $10^7$ Ω·cm or below, so that a current for image transfer can efficiently flow. When rubber is used, the nip for image transfer can be desirably formed. When use is made of a resin or rubber layer, its thickness should be between 0.1 mm and 5.0 mm.

The rollers 13 and 25 or 14 and 24, respectively facing the transfer rollers 14 and 24 or 13 and 25, are implemented as conductive rollers or electrode rollers and grounded, intensifying the electric fields and therefore promoting efficient image transfer. The rollers 13 and 25 or 14 and 24 each are formed of metal, resin or rubber and provided with resistance as low as $10^9$ Ω·cm or below, preferably $10^7$ Ω·cm or below, implementing effective grounding. When the rollers 13 and 25 or 14 and 24 are formed of rubber, they effectively form image transfer nip. When use is made of a resin or a rubber layer, its thickness should be between 0.1 mm and 5.0 mm. Carbon, for example, may be added to resin or rubber in order to control resistance.

While the conductive rollers 13 and 25 or 14 and 24, respectively facing the transfer rollers 14 and 24 or 13 or 25, are grounded in the first and second embodiments, a charge opposite in polarity to the bias for image transfer may be applied to each of such rollers 13 and 25 or 14 and 24. For example, in the first embodiment configured to apply a bias of the same polarity as the toner to each transfer roller, a charge opposite in polarity to the toner is applied to the roller facing the transfer roller. In the second embodiment configured to apply a bias opposite in polarity to the toner to the transfer roller for effecting repulsion image transfer, a charge of the same polarity as the toner is applied to the roller facing the transfer roller. This kind of scheme successfully increases the electric fields and therefore image transfer efficiency.

A power supply capable of applying charges of opposite polarities to the transfer roller and roller facing it is available. When such a power supply is used, there can be saved space and cost otherwise assigned to a plurality of power supplies.

In the configuration shown in FIG. 2, each transfer roller and roller facing it are arranged substantially side by side in the horizontal direction, i.e., pressed against each other with the intermediary of the first and second belts 8 and 20. Also, as shown in FIG. 5, a line S, virtually connecting the axis of each transfer roller and that of the roller facing it, and a direction of sheet conveyance P intersect each other at an angle θ of 90°. The direction P refers to a direction in which the first and second belts move together in contact with each other, i.e., the substantially vertical direction in FIG. 2.

Alternatively, the axis of the transfer roller and that of the roller facing it may be slightly shifted from each other in the direction perpendicular to the direction of sheet conveyance P such that the two rollers slightly overlap each other, as will be described with reference to FIGS. 6 through 9 hereinafter. Such an alternative arrangement increases the length of the nip between the above two rollers for thereby enhancing image transferability.

Figure 6:
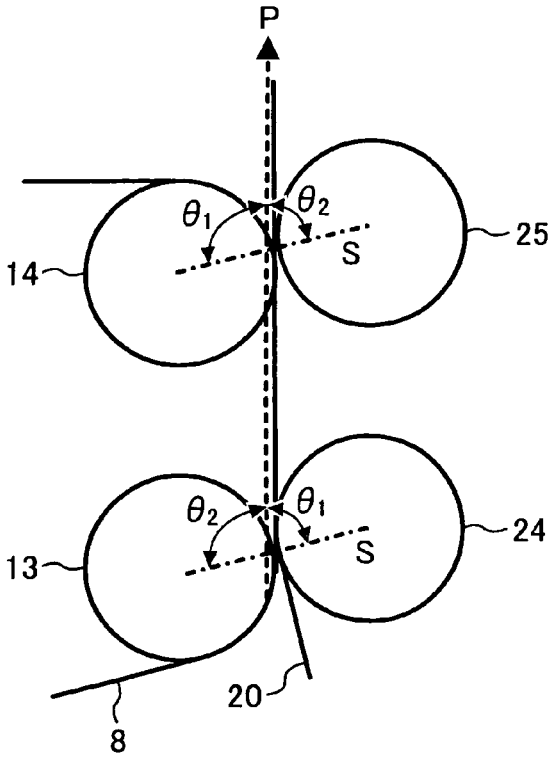
FIGS. 6 through 9 are enlarged views each showing a particular combination of two pairs of transfer rollers and rollers facing them.

FIG. 6 shows an arrangement in which the rollers 25 and 24, disposed in the loop of the second belt 20, are respectively positioned at higher levels than the rollers 14 and 13 facing them and disposed in the loop of the first belt 8. The rollers 14 and 25 or 24 and 13 slightly overlap each other and increase the nip than in the configuration shown in FIG. 5.

Figure 7:
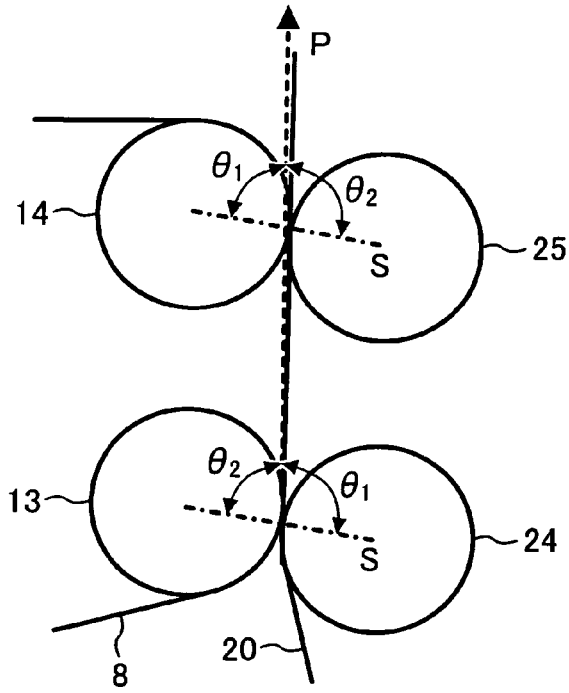
Figure 8:
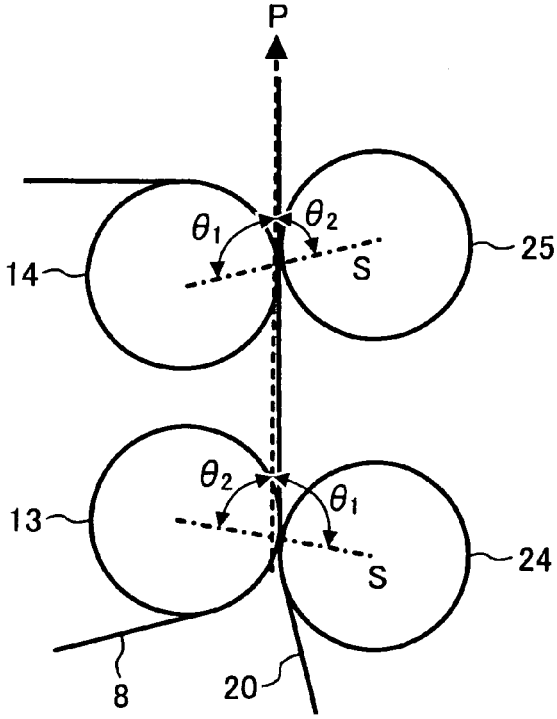
Figure 9:
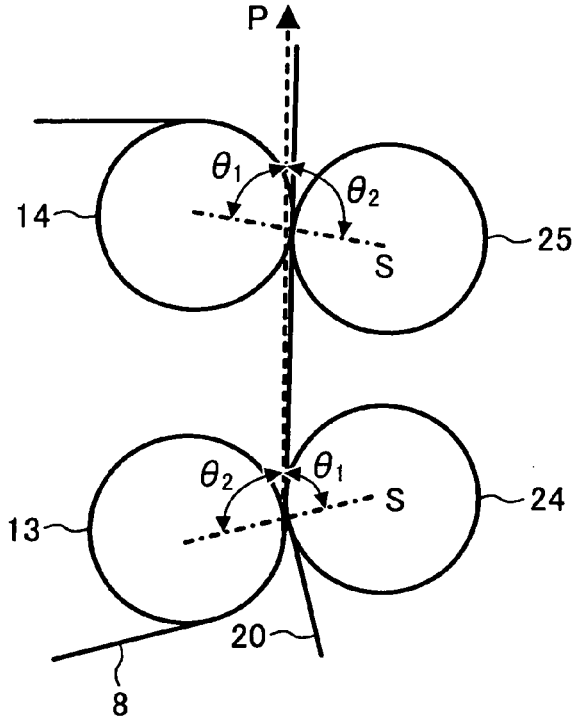

FIG. 7 shows an arrangement in which the roller 25, facing the transfer roller 24, and transfer roller 24 are respectively positioned at lower levels than the transfer roller 14 and roller 13 facing it. FIG. 8 shows an arrangement in which the roller 25, facing the transfer roller 14, is positioned at a higher level than the transfer roller 14 while the transfer roller 24 is positioned at a lower level than the roller 13 facing it. Further, FIG. 9 shows an arrangement in which the roller 25, facing the transfer roller 14, is positioned at a lower level than the transfer roller 14 while the transfer roller 24 is positioned at a higher level than the roller 13 facing it. In any one of such positional relations, the transfer roller and roller facing it may be replaced with each other.

The angle θ mentioned earlier should preferably be between 90±30°. If the angle θ is excessively great, then a sheet being conveyed is apt to move zigzag to thereby bring about image shift or similar defect.

In the specific arrangements shown in FIGS. 6 through 9, the angle θ includes an obtuse angle θ1 at the transfer roller side and an acute angle θ2 at the facing roller side. Because a relation of 180°−θ1=θ2 holds, so long as θ1 lies in the range of 90±30°, θ2 automatically lies in the same angle. Therefore, θ1 or θ2 may be selected as the angle θ between the virtual line S and the direction P of sheet conveyance.

In the configurations shown in FIGS. 6 through 9, too, a charge opposite in polarity to the charge applied to the ground roller or the transfer bias may be applied to the facing roller.

Figure 10:
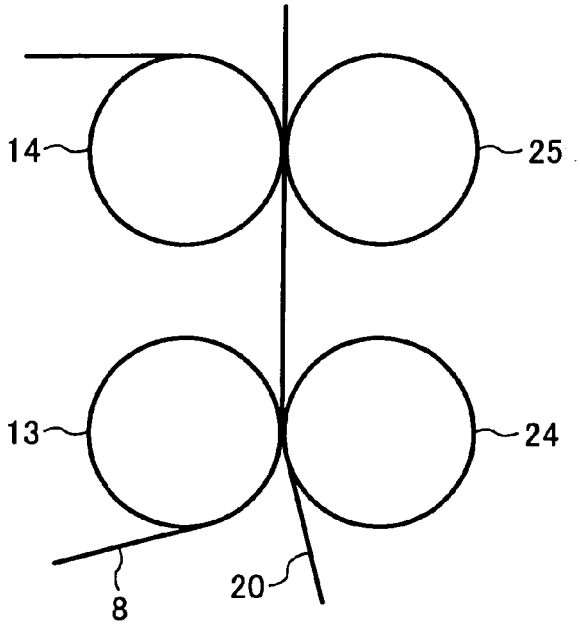
FIG. 10 is an enlarged view showing a specific configuration in which two image transferring means are disposed in the loop of the first image transfer belt.

FIG. 10 shows another specific configuration in which the transfer or secondary image transferring means 13 and transfer roller or tertiary image transferring means 14 both are disposed in the loop of the first belt 8. The ground rollers 24 and 25, respectively facing the transfer rollers 13 and 14, are disposed in the loop of the second belt 20. Repulsion image transfer and attraction image transfer are applied to the transfer rollers 13 and 14, respectively.

Figure 4:
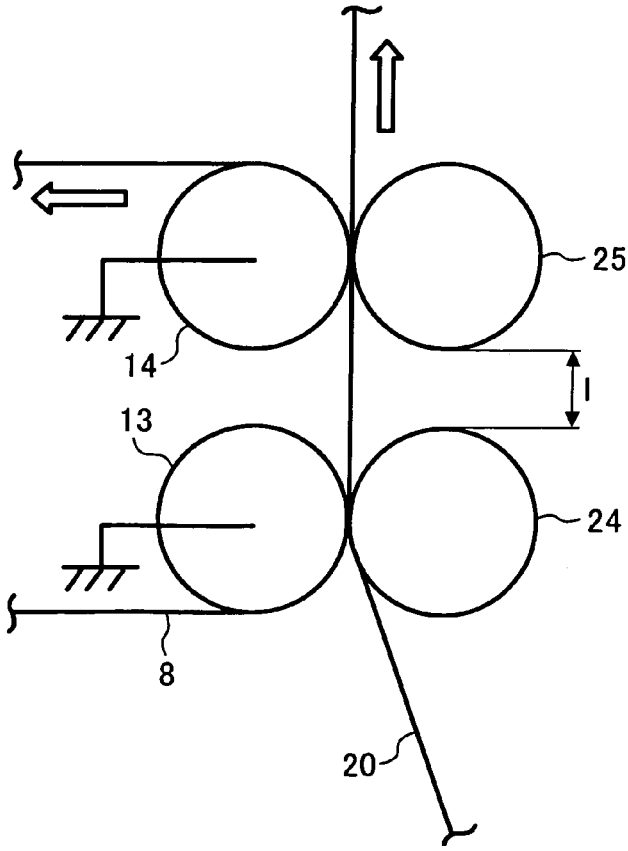
FIG. 4 is a fragmentary view showing a nip between a first and a second intermediate image transfer belt included in the first embodiment.

While the transfer roller and ground roller 13 and 24 or 14 and 25 are shown in FIG. 10 as being positioned substantially perpendicularly to the direction of sheet conveyance as in FIG. 4, they may be shifted from each other in such a manner as to slightly overlap each other as described with reference to FIGS. 6 through 9.

Figure 11:
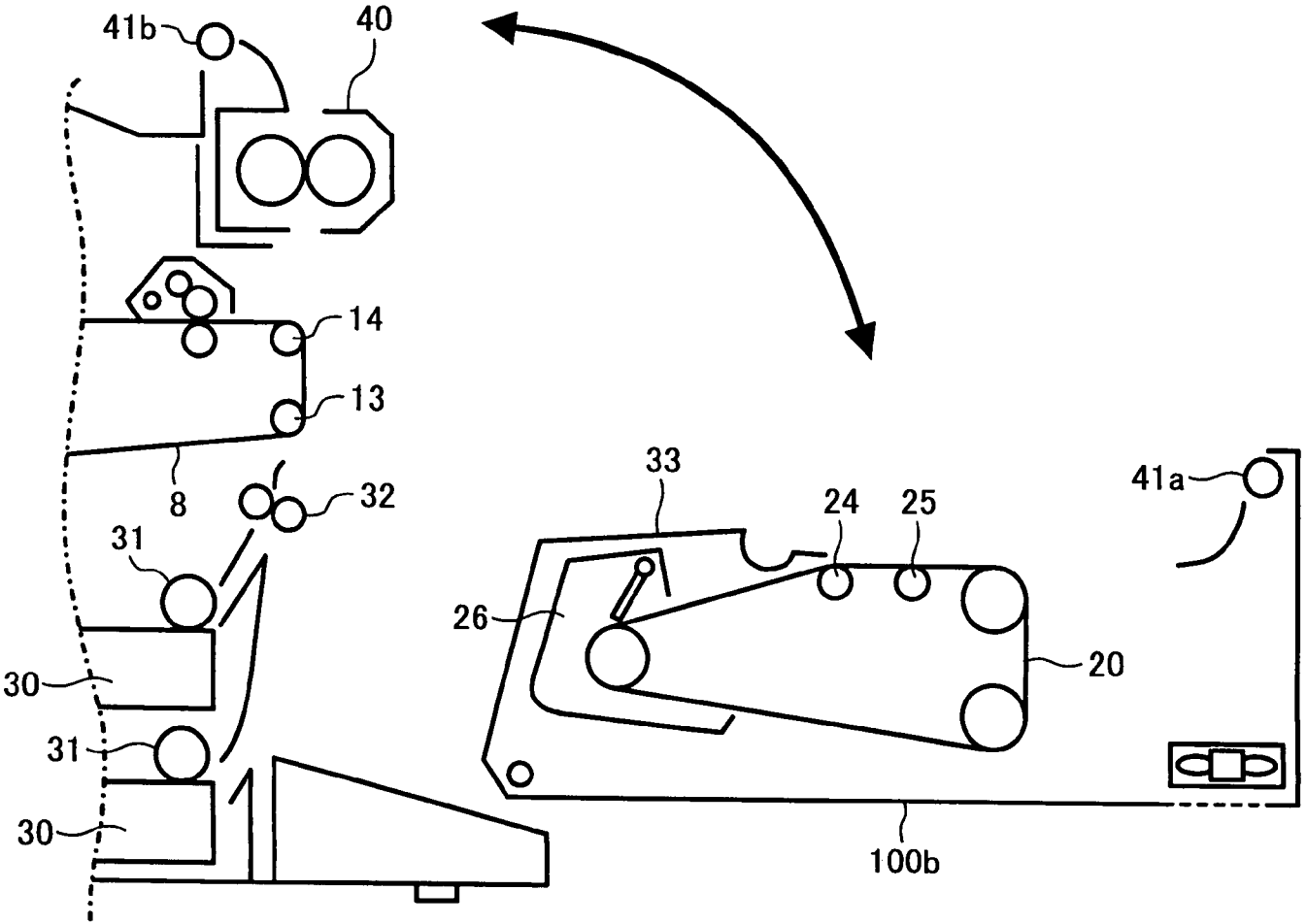
FIG. 11 shows a conveying unit including the second intermediate image transfer belt and openable away from the body of the image forming apparatus.

As shown in FIG. 11, in this specific configuration, a conveying unit 10*b*, including the second belt 20, is openable away from the printer body. In this case, if the roller 24 or 25 disposed in the loop of the second belt 20 is a transfer roller, then the contact of a high-tension power supply must be mounted on the conveying unit 100*b* so as to apply a bias to the roller 24 or 25. By contrast, the configuration shown in FIG. 10 makes it needless to mount the above contact on the openable, conveying unit 100*b*, and is therefore simple. Of course, troubles ascribable to the wear of the contact do not occur.

In any one of the specific configurations described above, the conductive rollers disposed in the loop of the first belt 8 or the second belt 20, e.g., the circumferential surface of the transfer roller 14 and that of the facing roller 13 or the facing roller 25 and transfer roller 24, FIG. 5, should be spaced from each other by 5 mm or above, but 200 mm or below, preferably 10 mm or above, but 100 mm or below. If the distance between such two rollers is excessively small, then the current for image transfer flows to the facing roller via the belt, lowering image transfer efficiency. On the other hand, in any one of the configurations shown in FIGS. 6 through 9, an excessively great distance is disadvantageous in maintaining the nip for image transfer. By contrast, the distance of between 5 mm and 200 mm, preferably between 10 mm and 100 mm, is successful to prevent image transfer efficiency or nip from being degraded.

In the configurations shown in FIGS. 5 through 10, when one of a pair of rollers facing each other, e.g., rollers 13 and 15 is implemented as a transfer roller, the other roller is implemented as a facing roller. Alternatively, the two rollers facing each other both may be implemented as transfer rollers. In such a case, when one roller is operating as a transfer roller, the other roller is grounded, i.e., not applied with a bias or vice versa. This allows image transfer to be effected by two secondary or tertiary image transferring means for thereby enhancing image transferability.

For example, in Example 6 to be described later, the roller 25 is used as secondary image transferring means while the roller 13 and roller 14, facing the roller 25, are used as first and second tertiary image transferring means, respectively. When the roller 14 is operating as tertiary image transferring means, the roller 25 is grounded. The two tertiary image transferring means 13 and 14 insure more positive image transfer from the second belt 20 to the reverse surface of a sheet.

Alternatively, in Example 4 to be described later, the roller 25 is used as transferring means for transferring an image from the belt 8 to the belt 20 while the roller 13 is used as transferring means for transferring an image from the belt 8 to the front surface of a sheet. Further, the roller 14 is used as transferring means for transferring the image from the belt 20 to the reverse surface of a sheet. Again, the distance between the circumferential surfaces of the two transfer rollers disposed in the loop of the same belt should be between 5 mm and 200 mm, preferably between 10 mm and 100 mm.

The printer shown in FIG. 2 may be configured as a simplex printer for forming an image on only one side of a sheet, as will be described hereinafter. As for the mechanical construction, the simplex printer is identical with the duplex printer of FIG. 2. In the simplex printer, the second belt 20 is used as a sheet conveying belt. Any one of the rollers 13, 14, 24 and 25 may be implemented as secondary image transferring means or transfer roller for transferring a toner image from the belt 8 to a sheet. For image transfer, use may be made of either one of electrostatic attraction and electrostatic repulsion, as desired. For example, when the roller 13 is used as secondary image transferring means, repulsion image transfer is effected with the roller 24 serving as a facing roller. More specifically, the facing roller 24 is grounded or applied with a charge opposite in polarity to the image transfer bias.

In Example 5 to be described later, the rollers 13 and 14 both are used as secondary image transferring means and effect repulsion image transfer. In this case, the rollers 24 and 25 are facing rollers, i.e., they are grounded or applied with charges opposite in polarity to the image transfer biases.

When the roller 24 is used as secondary image transferring means, attraction image transfer is effected with the roller 13 serving as a facing roller, i.e., being grounded or applied with a charge opposite in polarity to the image transfer bias.

Further, the rollers 24 and 25 both may be implemented as secondary image transferring means, in which case attraction image transfer will be effected with the rollers 13 and 14 serving as facing rollers.

If desired, attraction image transfer and repulsion image transfer may be combined together. For example, the rollers 13 and 25 may be respectively used as a transfer roller for effecting repulsion image transfer and a transfer roller for effective attraction image transfer, in which case biases applied to the rollers 13 and 25 will be opposite in polarity to each other. The rollers or facing rollers 24 and 14 each are grounded or applied with a charge opposite in polarity to the image transfer bias. Alternatively, the rollers 24 and 14 may be respectively implemented as an attraction and a repulsion image transfer roller, in which case the biases applied to the rollers 24 and 14 will be opposite in polarity to each other while the rollers or facing rollers 13 and 25 each will be grounded or applied with a charge opposite in polarity to the image transfer bias. Again, the distance between the circumferential surfaces of the rollers 13 and 14 or the rollers 24 and 25 disposed in the loop of the same belt should be between 5 mm and 200 mm, preferably 10 mm and 100 mm.

Specific examples of the first and second embodiments, presenting specific numerical values of image transfer currents and other factors, and comparative examples will be described hereinafter.

EXAMPLE 1

Attraction 1

A current of 20 μA, opposite in polarity to toner, is applied to the second transfer roller 24 so as to transfer a toner image to be transferred to the reverse surface of a sheet from the first belt 8 to the second belt 20. Subsequently, a current of 50 μA, also opposite in polarity to toner, is applied to the second transfer roller 24 to thereby transfer a toner image to be transferred to the front surface of a sheet from the first belt 8 to the front surface of a sheet. Thereafter, a current of 60 μA, also opposite in polarity to toner, is applied to the tertiary transfer roller 14 to thereby transfer the toner image from the second belt 20 to the reverse surface of the sheet. At this instant, the facing rollers 13 and 2.5 are grounded and spaced from each other by 20 mm. The sheet is then smoothly conveyed with the toner images thereof desirably fixed, as determined by experiments.

In Example 1 stated above, the secondary and tertiary image transferring means both implemented as contact type of image transferring means produced substantially no ozone. Further, toner was not scattered at all because a sheet with toner was not charged.

EXAMPLE 2

Repulsion 1

A current of 30 μA of the same polarity as toner is applied to the second transfer roller 13 so as to transfer a toner image to be transferred to the reverse surface of a sheet from the first belt 8 to the second belt 20. Subsequently, a current of 60 μA of the same polarity as toner is applied to the second transfer roller 13 to thereby transfer a toner image to be transferred to the front surface of a sheet from the first belt 8 to the front surface of a sheet. Thereafter, a current of 60 μA of the same polarity as toner is applied to the tertiary transfer roller 25 to thereby transfer the toner image from the second belt 20 to the reverse surface of the sheet. At this instant, the facing rollers 24 and 14 are grounded and spaced from each other by 10 mm. The sheet is then smoothly conveyed with the toner images thereof desirably fixed, as determined by experiments.

In Example 2, the secondary and tertiary image transferring means both implemented as contact type of image transferring means produced substantially no ozone. Further, toner was not scattered at all because a sheet with toner was not charged.

EXAMPLE 3

(Repulsion 2)

A current of 30 μA of the same polarity as toner is applied to the second transfer roller 13 so as to transfer a toner image to be transferred to the reverse surface of a sheet from the first belt 8 to the second belt 20. Subsequently, a current of 55 μA of the same polarity as toner is applied to the second transfer roller 13 to thereby transfer a toner image to be transferred to the front surface of a sheet from the first belt 8 to the front surface of a sheet. Thereafter, a current of 65 μA of the same polarity as toner is applied to the tertiary transfer roller 25 to thereby transfer the toner image from the second belt 20 to the reverse surface of the sheet. At this instant, the facing rollers 24 and 14 are grounded and spaced from each other by 10 mm. The sheet is then smoothly conveyed with the toner images thereof desirably fixed, as determined by experiments.

In Example 3, the secondary and tertiary image transferring means both implemented as contact type of image transferring means produced substantially no ozone. Further, toner was not scattered at all because a sheet with toner was not charged.

EXAMPLE 4

(Attraction+Repulsion)

A current of 20 μA, opposite in polarity to toner, is applied to the secondary transfer roller 25 to thereby transfer a toner image to be transferred to the reverse surface of a sheet from the first belt 8 to the second belt 20. Subsequently, a current of 55 μA of the same polarity as toner is applied to the secondary transfer roller 13 to thereby transfer a toner image to be transferred to the front surface of a sheet from the first belt 8 to the front surface of a sheet. Thereafter, a current of 65 μA is applied to the tertiary transfer roller 14 to thereby transfer the toner image from the belt 20 to the reverse surface of the sheet. At this instant, the rollers 14, 24 and 25 are grounded when not used for image transfer. The transfer rollers 13 and 14 are spaced from each other by 10 mm while the transfer rollers 13 and 25 are spaced from each other by 10 mm or more. The rollers 13, 14 and 25, playing the role of image transferring means, each have a rubber layer on the surface and resistance of $10^7$ μ·cm. The sheet is then smoothly conveyed with the toner images thereof desirably fixed, as determined by experiments.

In Example 4, the secondary and tertiary image transferring means both implemented as contact type of image transferring means produced substantially no ozone. Further, toner sufficiently adhered to the sheet and was not scattered at all.

EXAMPLE 5

(Simplex Print 1; Repulsion)

The rollers 13 and 14 are used as transfer rollers and applied with a current of 20 A each, transferring a toner image from the belt 8 to a sheet. At this instant the rollers 24 and 25, respectively facing the transfer rollers 13 and 14, are grounded. The transfer rollers 13 and 14 are spaced from each other by 15 mm. The sheet is then smoothly conveyed with the toner images thereof desirably fixed, as determined by experiments. In Example 5, the secondary image transferring means implemented as contact type of image transferring means produced substantially no ozone.

EXAMPLE 6

(Simplex Print 2; Attraction)

The roller 25 is used as a secondary transfer roller and applied with a current of 20 μA opposite in polarity to toner, transferring a toner image from the first belt 8 to the second belt 20. Further, the rollers 13 and 14 are used as tertiary transfer rollers and applied with a current of 20 μA opposite in polarity to toner, transferring the toner image from the second belt 20 to a sheet. In this case, the sheet with the toner image is driven out of the printer face up. The rollers 14, 24 and 25, facing the transfer rollers, are grounded when not used for image transfer. The transfer rollers 13 and 14 are spaced from each other by 15 mm while the transfer rollers 13 and 25 are spaced from each other by 15 mm or more. The sheet is then smoothly conveyed with the toner images thereof desirably fixed, as determined by experiments. In Example 6, the secondary image transferring means implemented as contact type of image transferring means produced substantially no ozone.

COMPARATIVE EXAMPLE 1

A current of 30 A of the same polarity as toner is applied to the secondary transfer roller 14 or 13 to thereby transfer a toner image to be transferred to the reverse surface of a sheet from the first belt 8 to the second belt 20. Subsequently, a current of 60 A of the same polarity as toner is applied to the secondary transfer roller 14 or 14 to thereby transfer a toner image to be transferred to the front surface of a sheet from the first belt 8 to the front surface of a sheet. Thereafter, a current of 60 A of the same polarity as toner is applied to the tertiary transfer roller 24 or 25 for thereby transferring the toner image from the second belt 20 to the reverse surface of the sheet. At this instant, the rollers 25 and 13 or 24 and 14, facing the transfer rollers, are held in a floating state or implemented by insulative rollers.

Experiments conducted with Comparative Example 1 showed that almost no toner images were present on both sides of the sheet after fixation. Moreover, only one-half of consecutive sheets or less were conveyed to the fixing unit 40 due to defective conveyance.

COMPARATIVE EXAMPLE 2

A current of 20 A, opposite in polarity to toner, is applied to the secondary transfer roller 24 or 25 to thereby transfer a toner image to be transferred to the reverse surface of a sheet to the second belt 20. Subsequently, a current of 50 A, opposite in polarity to toner, is applied to the secondary transfer roller 24 or 25 to thereby transfer a toner image to be transferred to the front surface of a sheet from the first belt 8 to the front surface of a sheet. Thereafter, a current of 60 A, opposite in polarity to toner, is applied to the tertiary transfer roller 14 or 13 for thereby transferring the toner image from the second belt 20 to the reverse surface of the sheet. While the rollers 25 and 13 or 24 and 14, facing the transfer rollers, are grounded, the transfer rollers are spaced from each other by 2 mm. When the above sheet was conveyed via the fixing unit 40, the images on the sheet were found to be poor due to extremely short image transferability.

Third Embodiment

Figure 12:
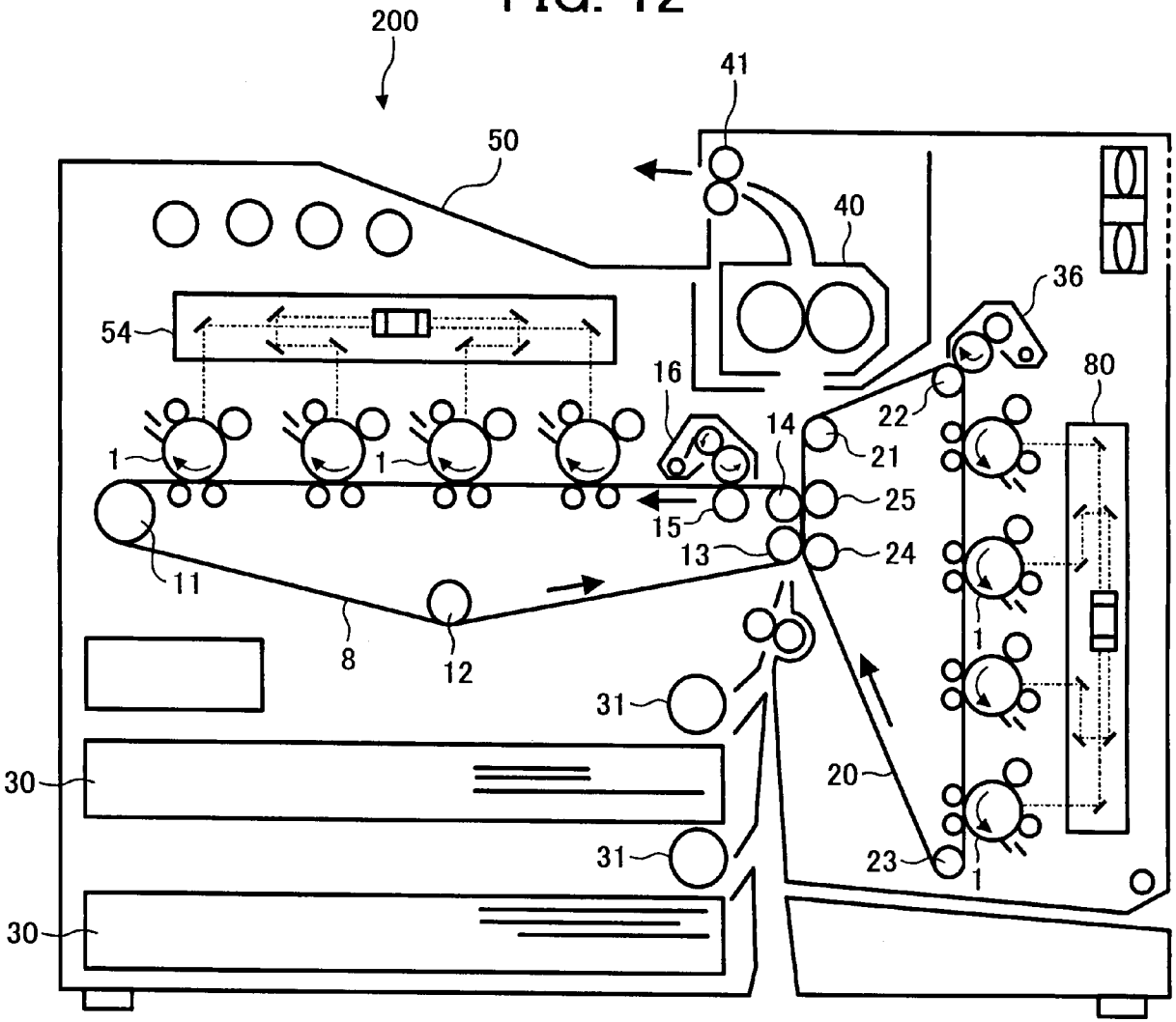
FIG. 12 is a view showing a third embodiment of the present invention.

Reference will be made to FIG. 12 for describing a third embodiment of the present invention, which is implemented as a color printer including two groups of image forming sections. As shown, the color printer, generally 200, includes four image forming units arranged along one run of the second belt 20 and each including the respective drum 1. A second exposing unit 80 adjoins such four image forming units. These image forming units and exposing unit 80 constitute a second image forming section arranged around the second belt 20, as distinguished from a first image forming section arranged around the first belt 8. The first and second image forming sections share the sheet cassettes 30 and fixing unit 40.

Each image forming unit included in the second image forming section is identical in configuration with the image forming unit of the printer 100, FIG. 2. The exposing unit 80 has the same configuration as the exposing unit 54, FIG. 2, while a cleaner 36, assigned to the second belt 20, has the same configuration as the cleaner 16, FIG. 2. In the illustrative embodiment, the cleaner 36 can be constantly held in contact with the second belt 20, so that a mechanism for moving the cleaner 36 into or out of contact with the belt 20 is not necessary.

In operation, in a duplex print mode, a toner image formed by the first image forming section is transferred from the first belt 8 to one surface of a sheet while a toner image formed by the second image forming section is transferred from the second belt 20 to the other surface of the sheet. The sheet, carrying the toner images on both surfaces thereof, is driven out to the stack tray 50 via the fixing unit 40. In each image forming section, non-inverted or non-mirror images formed on the drums 1 are transferred to the belt 8 or 20 one above the other in the form of an inverted or mirror image. The inverted image is then transferred to a sheet as a non-inverted or non-mirror image. In the case where consecutive sheets should be stacked on the stack tray 50 face down in order of page, the image formed by the first image forming section and the image formed by the second image forming section are a front-surface image and a reverse-surface image, respectively.

With the above configuration, the illustrative embodiment does not have to transfer an image from the first belt 8 to the second belt 20 and therefore achieves high duplex print productivity. Further, in a duplex color mode, the illustrative embodiment should only superpose toners of different colors on both surfaces of a sheet in the same order, providing images on both sides of a sheet with the same tone and therefore enhancing image quality.

In a simplex print mode, when consecutive sheets should be driven out to the stack tray 50 face down in order of page, an image is formed only by the first image forming section and then transferred to one surface of a sheet. In this case, the images formed on the drums 1 of the first image forming section are non-inverted images while the resulting color image transferred to the first belt 8 is an inverted image. The inverted image on the first belt 8 is transferred to a sheet as a non-inverted image.

On the other hand, when consecutive sheets should be driven out to the stack tray face up in order of page in the simplex print mode, an image is formed only by the second image forming section and then transferred to one surface of a sheet. In this case, images are formed in reverse order as to page. Images formed on the drums 1 of the second image forming section are non-inverted images while the resulting color image is transferred to the second belt 20 as an inverted image. The inverted image on the second belt 20 is then transferred to a sheet as a non-inverted image.

In the illustrative embodiment, assume that image transfer from the drums 1 of each image forming section to the first belt 8 or the second belt 20 is primary image transfer, that image transfer from the first belt 8 to a sheet is secondary image transfer, and that image transfer from the second belt 20 to the same sheet is tertiary image transfer. Then, all of the primary to tertiary image forming means are of contact type and therefore do not produce discharge products. Also, the toner deposited on the second belts 8 and 20 or the toner transferred to a sheet is not scattered around, so that various members around the belt 20 are free from contamination.

Further, the illustrative embodiment does not need a mechanism for switching the polarity of toner images or similar additional mechanism and is therefore simple and low cost. In addition, all image forming means are disposed in the loop of the belts 8 and 20 and therefore protected from damage in the event of jam processing.

The illustrative embodiment, like the first and second embodiments, can use repulsion image transfer in place of attraction image transfer for the secondary and tertiary image transfer. FIGS. 13 through 16 each show a particular arrangement for transferring images from the first and second belts 8 and 20 to a sheet. In FIGS. 13 through 16, arrows a and b indicate secondary image transfer and tertiary image transfer, respectively.

Figure 13:
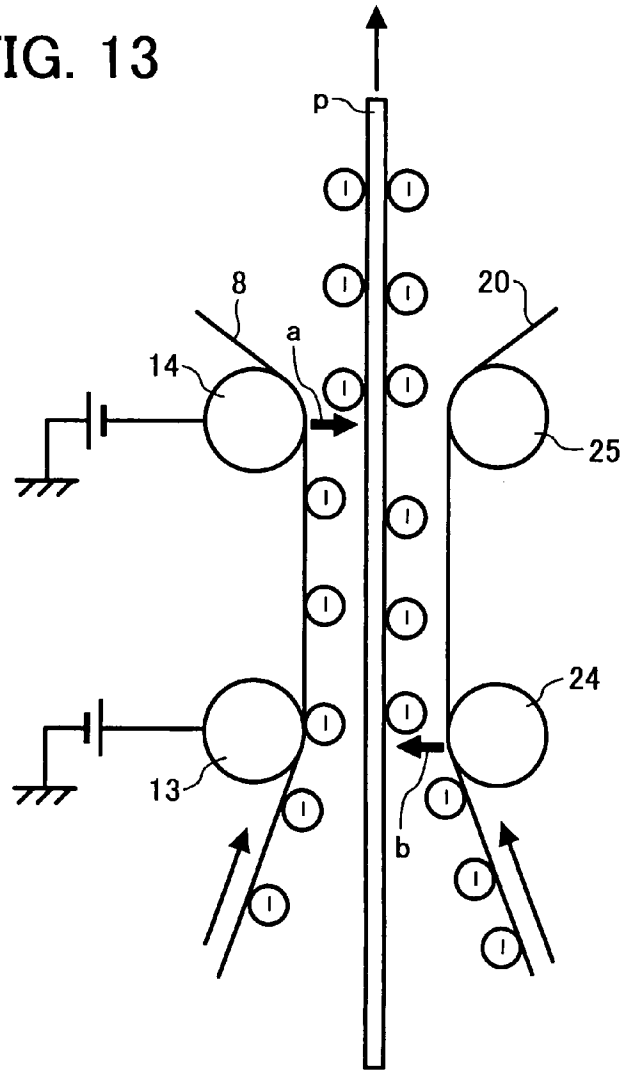
FIG. 13 is an enlarged view showing a specific configuration in which secondary and tertiary image transferring means are disposed in the loop of the first intermediate image transfer belt.

FIG. 13 shows an arrangement in which the secondary and tertiary image transferring means are disposed in the loop of the first belt 8. In this arrangement, repulsion and attraction are respectively applied to image transfer from the first belt 8 to a sheet, arrow a, and image transfer from the second belt 20 to the sheet, arrow b. Assuming that toner is of negative polarity, then a bias of negative polarity is applied to the transfer roller or secondary image transferring means 14, so that an image is transferred from the first belt 8 to one surface of a sheet, which is assumed to be the front surface, by repulsion. A bias of positive polarity is applied to the transfer roller or tertiary image transferring means 13, so that an image is transferred from the second belt 20 to the reverse surface of the sheet by attraction. The polarity of toner and that of each bias may be replaced with each other, if desired.

Figure 14:
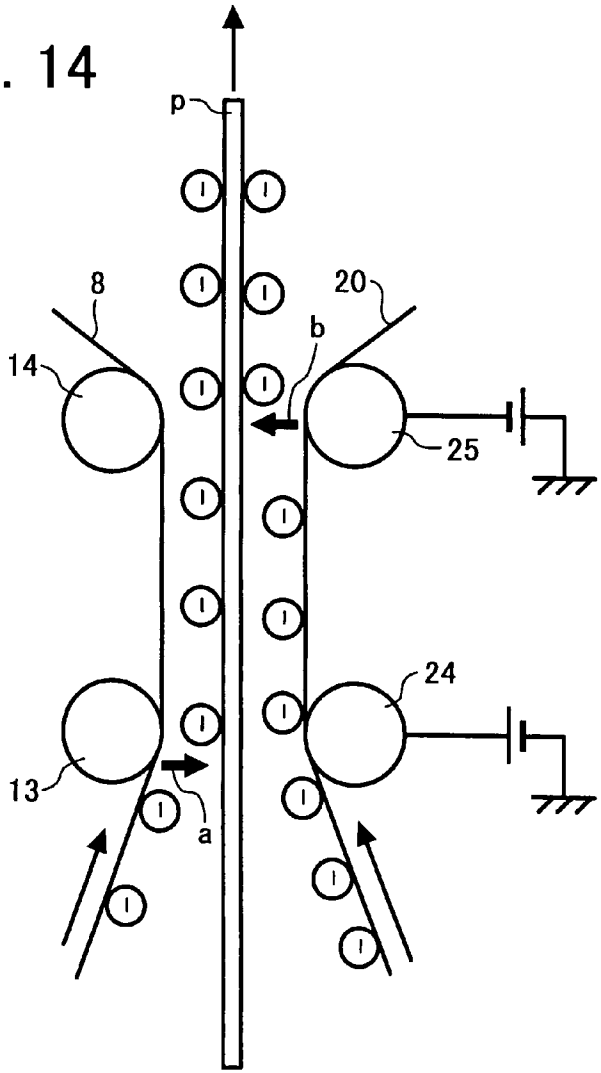
FIG. 14 is an enlarged view showing a specific configuration in which the secondary and tertiary image transferring means are disposed in the loop of the second intermediate image transfer belt.

FIG. 14 shows an arrangement in which the secondary and tertiary image transferring means are disposed in the loop of the second belt 20. In this arrangement, attraction and repulsion are respectively applied to image transfer from the first belt 8 to a sheet, arrow a, and image transfer from the second belt 20 to the sheet, arrow b. Assuming that toner is of negative polarity, then a bias of positive polarity is applied to the transfer roller or secondary image transferring means 24, so that an image is transferred from the first belt 8 to one surface of a sheet, which is assumed to be the front surface, by attraction. A bias of negative polarity is applied to the transfer roller or tertiary image transferring means 25, so that an image is transferred from the second belt 20 to the reverse surface of the sheet by repulsion. The polarity of toner and that of each bias may be replaced with each other, if desired.

Figure 15:
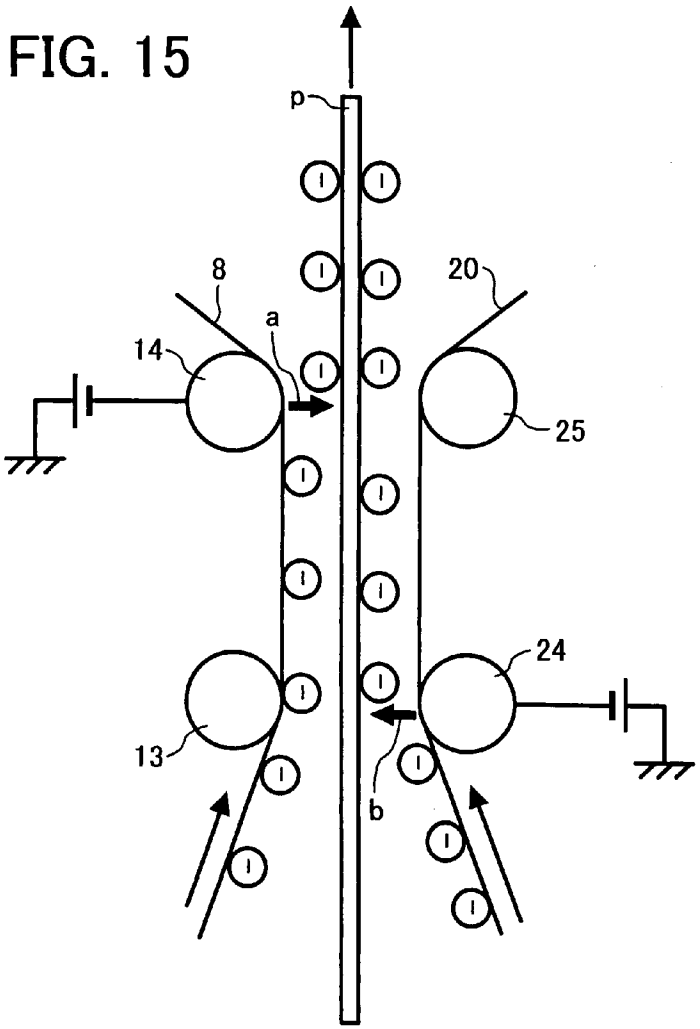
FIG. 15 is an enlarged view showing a specific configuration in which the secondary and tertiary image transferring means are respectively disposed in the loop of the first intermediate image transfer belt and that of the second intermediate image transfer belt.

FIG. 15 shows an arrangement in which the secondary and tertiary image transferring means are respectively disposed in the loop of the first belt 8 and the loop of the second belt 20. In this case, repulsion image transfer is applied to both of image transfer from the first belt 8 to a sheet, arrow a, and image transfer from the second belt 20 to the sheet, arrow b. Assuming that toner is of negative polarity, then a bias of negative polarity is applied to the transfer roller or secondary image transferring means 14, so that an image is transferred from the first belt 8 to one surface of a sheet, which is assumed to be the front surface, by repulsion. A bias of negative polarity is applied to the transfer roller or tertiary image transferring means 24 also, so that an image is transferred from the second belt 20 to the reverse surface of the sheet by repulsion. The polarity of toner and that of each bias may be replaced with each other, if desired.

Figure 16:
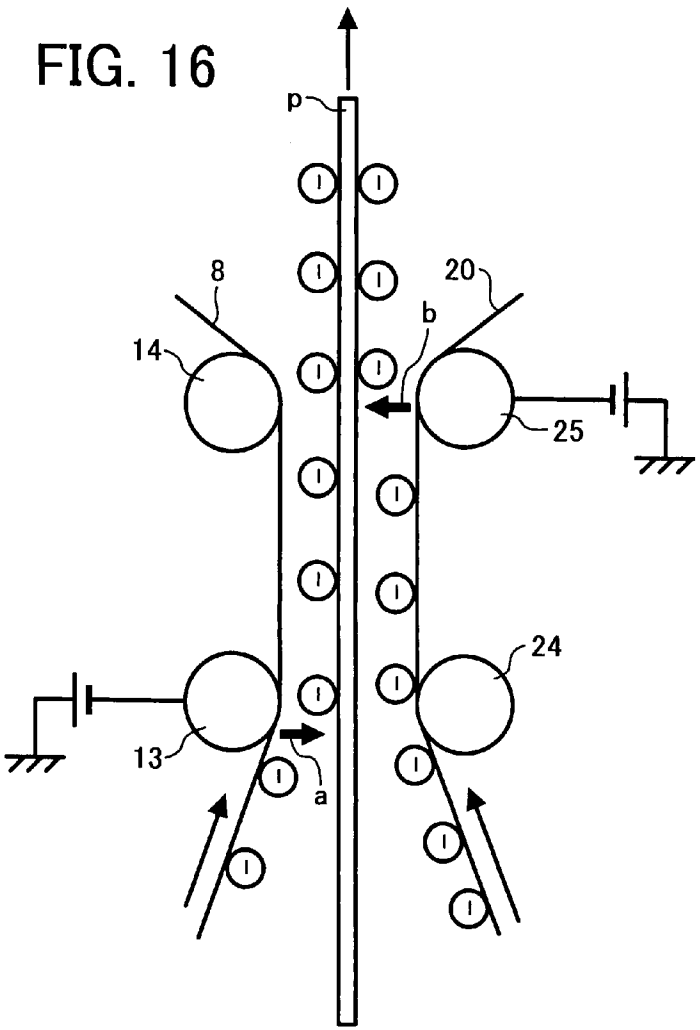
FIG. 16 is an enlarged view showing another specific configuration in which the secondary and tertiary image transferring means are respectively disposed in the loop of the first intermediate image transfer belt and that of the second intermediate image transfer belt.

FIG. 16 shows another arrangement in which the secondary and tertiary image transferring means are respectively disposed in the loop of the first belt 8 and the loop of the second belt 20. In FIG. 15, the transfer roller or secondary image transferring means 14 and transfer roller or tertiary image transferring means 24 are positioned at the outlet and inlet of the nip, respectively. By contrast, in FIG. 16, the transfer roller or secondary image transferring means 13 and transfer roller or tertiary image transferring means 25 are positioned at the inlet and outlet of the nip, respectively. Again, repulsion image transfer is applied to both of image transfer from the first belt 8 to a sheet, arrow a, and image transfer from the second belt 20 to the sheet, arrow b. Assuming that toner is of negative polarity, then a bias of negative polarity is applied to the transfer roller or secondary image transferring means 13, so that an image is transferred from the first belt 8 to one surface of a sheet, which is assumed to be the front surface, by repulsion. A bias of negative polarity is applied to the transfer roller or tertiary image transferring means 25 also, so that an image is transferred from the second belt 20 to the reverse surface of the sheet by repulsion. The polarity of toner and that of each bias may be replaced with each other, if desired.

In the specific configurations shown in FIGS. 13 through 16, the rollers, facing the transfer rollers, are conductive rollers or electrode rollers grounded as in the first and second embodiments. The transfer rollers and such facing rollers each are formed of the same material as in the first and second embodiments. Also, a charge, opposite in polarity to the bias applied to each transfer roller, may be applied to the roller facing the transfer roller, as described in relation to the first and second embodiments. Further, each transfer roller and roller facing it may be applied with a charge from the same power supply as in the first and second embodiments.

Any one of the angles θ described with reference to in FIGS. 5 through 9 is applicable to the illustrative embodiment as well.

The secondary and tertiary image transfer rollers should be spaced from each other by 5 mm or more, preferably 10 mm or more, so as to obviate the interference of electric fields more positively. Further, the conductive rollers disposed in the loop of the first belt 8 or the second belt 20, e.g., the transfer roller 14 and facing roller 13, FIG. 13, or the transfer roller 25 and facing roller 24, FIG. 16, should be spaced from each other by 5 mm or above, but 200 mm or below, preferably 10 mm or above, but 100 mm or below. This successfully prevents image transfer efficiency or nip from being degraded.

If desired, a pair of rollers facing each other both may be implemented as transfer rollers. In such a case, when one roller is operating as a transfer roller, the other roller is grounded, i.e., not applied with a bias or vice versa. This allows image transfer to be effected by two secondary or tertiary image transferring means for thereby enhancing image transferability. When two transfer rollers are disposed in the loop of the same belt, the two rollers should also be spaced from each other by 5 mm or above, but 200 mm or below, preferably 10 mm or above, but 100 mm or below.

The specific numerical values stated in Examples 1 through 6 of the previous embodiments similarly apply to the illustrative embodiment except that the illustrative embodiment omits image transfer from the first belt 8 to the second belt 20.

In the illustrative embodiments shown and described, the contact type of image transferring means 6, 13, 14, 24 and 25 are implemented by rollers. Alternatively, such image transferring means may be implemented by blades, brushes or brush rollers, if desired. In the case of blades, the distance between the image transferring means and facing roller or two image transferring means disposed in the loop of the same belt is the distance between the points thereof contacting the belt. Also, the current values and the distance between the secondary and tertiary image transferring means shown and described are only illustrative.

Further, each drum 1 may be replaced with a photoconductive belt while the various process units arranged around the drum 1 each may use any one of conventional systems. Of course, the color printer shown and described is a specific form of an image forming apparatus to which the present invention is applicable and may be replaced with a copier or a facsimile apparatus by way of example.

Various modifications will become possible for those skilled in the art after receiving the teachings of the present disclosure without departing from the scope thereof.

What is claimed is:

1. An image forming apparatus capable of forming images on both surfaces of a recording medium, said image forming apparatus comprising:

an image carrier; and an image transferring device including a first and a second intermediate image transfer body whose surfaces are endlessly movable in contact with each other while forming a nip therebetween, said image transferring device being configured to transfer, while conveying the recording medium nipped by said nip toward a side downstream of said nip in a direction in which said surfaces are endlessly movable, a first toner image transferred from said image carrier to said second intermediate image transfer body via said first intermediate image transfer body beforehand to a first surface of said recording medium and transfer a second toner image transferred from said image carrier to said first intermediate image transfer body to a second surface of said recording medium;

wherein first-surface image transferring means and second-surface image transferring means for respectively transferring the first toner image and the second toner image to the first surface and the second surface of the recording medium, respectively, comprise two pairs of conductive rollers that face each other via the surfaces of said first intermediate image transfer body and said second intermediate image transfer body at the nip, and wherein two of said conductive rollers associated with said second intermediate image transfer body comprise transfer rollers respectively applied with one and the other of biases a and b of opposite polarities.

2. The apparatus as claimed in claim 1, wherein the bias a, opposite in polarity to toner, is variable in accordance with a kind of the recording medium.

3. The apparatus as claimed in claim 1, wherein the biases a and b applied to said two transfer rollers at the nip are related as:

$$a+b\neq 0.$$

4. The apparatus as claimed in claim 3, wherein assuming that the biases a and b are respectively applied to said transfer rollers respectively positioned at an upstream side and a downstream side in a direction in which the recording medium is conveyed, then said bias a is opposite in polarity to toner while said bias b is of a same polarity as the toner, and wherein said biases a and b are related as:

$$|a|>|b|.$$

5. The apparatus as claimed in claim 4, wherein the bias a, opposite in polarity to toner, is variable in accordance with a kind of the recording medium.

6. The apparatus as claimed in claim 1, wherein the conductive rollers, facing said transfer rollers, each comprise either one of an electrode roller and a ground roller.

7. The apparatus as claimed in claim 6, wherein the biases a and b applied to said two transfer rollers at the nip are related as:

$$a+b\neq 0.$$

8. The apparatus as claimed in claim 7, wherein assuming that the biases a and b are respectively applied to said transfer rollers respectively positioned at an upstream side and a downstream side in a direction in which the recording medium is conveyed, then said bias a is opposite in polarity to toner while said bias b is of a same polarity as the toner, and wherein said biases a and b are related as:

$$|a|>|b|.$$

9. The apparatus as claimed in claim 8, wherein the bias a, opposite in polarity to toner, is variable in accordance with a kind of the recording medium.

10. An image forming apparatus comprising:

an image carrier and a first and a second intermediate image transfer body, and configured to transfer a toner image from said image carrier to said second intermediate image transfer body via said first intermediate image transfer body beforehand and from said second intermediate image transfer body to one surface of a recording medium, and further configured to transfer a toner image from said image carrier to said first intermediate image transfer body and from said first intermediate image transfer body to the other surface of said recording medium, first image transferring means disposed in said second intermediate image transfer body for transferring said toner image present on said first intermediate image transfer body to either one of said second intermediate image transfer body and said other surface of said recording medium, and second image transferring means disposed in said first intermediate image transfer body for transferring the toner image present on said second intermediate image transfer body to said one surface of said recording medium, wherein facing rollers, respectively facing said first and second image transferring means, each is disposed in the intermediate image transfer body where the respectively faced image transferring means is not disposed.

11. The apparatus as claimed in claim 10, wherein a charge applied to said first image transferring means and a charge applied to said second image transferring means are of a same polarity, which is opposite to a polarity of toner.

12. The apparatus as claimed in claim 11, wherein said first and second image transferring means comprise transfer rollers whose circumferential surfaces are spaced by a distance of 5 mm or above, preferably 10 mm or above.

13. The apparatus as claimed in claim 10, wherein conductive rollers, respectively facing said image transferring means, each is disposed in one of the first and second intermediate image transfer bodies and grounded or applied with a charge opposite in polarity to a charge applied to said image transferring means.

14. The apparatus as claimed in claim 13, wherein said first and second image transferring means comprise transfer rollers, and wherein each of said transfer rollers and the conductive roller facing said transfer roller are pressed against each other via said first intermediate image transfer body and said second intermediate image transfer body while overlapping each other in a direction perpendicular to a direction in which said first intermediate image transfer body and said second intermediate image transfer body move in contact with each other.

15. The apparatus as claimed in claim 14, wherein said conductive roller is grounded or applied with a charge opposite in polarity to a charge applied to said first and second image transferring means, and wherein when one of said transfer rollers, facing each other, is used as a transfer roller, the other transfer roller is grounded.

16. The apparatus as claimed in claim 14, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

17. The apparatus as claimed in claim 14, wherein an angle between a line virtually connecting axes of said transfer roller and said conductive roller, facing each other, or axes of said transfer rollers, facing each other, and the direction in which said first intermediate image transfer body and said second intermediate image transfer body move in contact with each other lies in a range of 90±30°.

18. The apparatus as claimed in claim 14, wherein said conductive roller comprises a roller formed of metal, resin or rubber and having a resistance as low as $10^9$ Ω·cm or below.

19. The apparatus as claimed in claim 18, wherein when said transfer roller and said conductive roller each comprise a roller formed of resin or rubber, said resin or said rubber forms a 0.1 mm to 5.0 mm thick layer.

20. The apparatus as claimed in claim 13, wherein said conductive roller is grounded or applied with a charge opposite in polarity to a charge applied to said first and second image transferring means, and wherein when one of said transfer rollers, facing each other, is used as a transfer roller, the other transfer roller is grounded.

21. The apparatus as claimed in claim 13, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

22. The apparatus as claimed in claim 13, wherein said conductive roller comprises a roller formed of metal, resin or rubber and having a resistance as low as $10^9$ Ω·cm or below.

23. The apparatus as claimed in claim 22, wherein when said transfer roller and said conductive roller each comprise a roller formed of resin or rubber, said resin or said rubber forms a 0.1 mm to 5.0 mm thick layer.

24. The apparatus as claimed in claim 10, wherein said first and second image transferring means comprise transfer rollers whose circumferential surfaces are spaced by a distance of 5 mm or above, preferably 10 mm or above.

25. The apparatus as claimed in claim 10, wherein said first and second image transferring means each comprise a transfer roller formed of rubber and having a resistance as low as $10^9$ Ω·cm or below.

26. The apparatus as claimed in claim 25, wherein when said transfer roller and said conductive roller each comprise a roller formed of resin or rubber, said resin or said rubber forms a 0.1 mm to 5.0 mm thick layer.

27. An image forming apparatus comprising:

an image carrier and a first and a second intermediate image transfer body, and configured to transfer a toner image from said image carrier to said second intermediate image transfer body via said first intermediate image transfer body beforehand and from said second intermediate image transfer body to one surface of a recording medium, and further configured to transfer a toner image from said image carrier to said first intermediate image transfer body and from said first intermediate image transfer body to the other surface of said recording medium, first image transferring means disposed in said first intermediate image transfer body for transferring said toner image present on said first intermediate image transfer body to either one of said second intermediate image transfer body and said other surface of said recording medium, and second image transferring means disposed in said second intermediate image transfer body for transferring said toner image present on said second intermediate image transfer body to said one surface of said recording medium wherein facing rollers, respectively facing said first and second image transferring means, each is disposed in the intermediate image transfer body where the respectively faced image transferring means is not disposed.

28. The apparatus as claimed in claim 27, wherein a charge applied to said first and second image transferring means disposed in said first intermediate image transfer body and a charge applied to said first and second image transferring means disposed in said second intermediate image transfer body are of a same polarity, which is identical with a polarity of toner.

29. The apparatus as claimed in claim 28, wherein said first and second image transferring means comprise transfer rollers whose circumferential surfaces are spaced by a distance of 5 mm or above, preferably 10 mm or above.

30. The apparatus as claimed in claim 27, wherein conductive rollers, respectively facing said image transferring means, each is disposed in one of the first and second intermediate image transfer bodies and grounded or applied with a charge opposite in polarity to a charge applied to said image transferring means.

31. The apparatus as claimed in claim 30, wherein said first and second image transferring means comprise transfer rollers, and wherein each of said transfer rollers and the conductive roller facing said transfer roller are pressed against each other via said first intermediate image transfer body and said second intermediate image transfer body while overlapping each other in a direction perpendicular to a direction in which said first intermediate image transfer body and said second intermediate image transfer body move in contact with each other.

32. The apparatus as claimed in claim 31, wherein said conductive roller is grounded or applied with a charge opposite in polarity to a charge applied to said first and second image transferring means, and wherein when one of said transfer rollers, facing each other, is used as a transfer roller, the other transfer roller is grounded.

33. The apparatus as claimed in claim 31, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

34. The apparatus as claimed in claim 31, wherein an angle between a line virtually connecting axes of said transfer roller and said conductive roller, facing each other, or axes of said transfer rollers, facing each other, and the direction in which said first intermediate image transfer body and said second intermediate image transfer body move in contact with each other lies in a range of 90±30°.

35. The apparatus as claimed in claim 31, wherein said conductive roller comprises a roller formed of metal, resin or rubber and having a resistance as low as $10^9$ Ω·cm or below.

36. The apparatus as claimed in claim 35, wherein when said transfer roller and said conductive roller each comprise a roller formed of resin or rubber, said resin or said rubber forms a 0.1 mm to 5.0 mm thick layer.

37. The apparatus as claimed in claim 30, wherein said conductive roller is grounded or applied with a charge opposite in polarity to a charge applied to said first and second image transferring means, and wherein when one of said transfer rollers, facing each other, is used as a transfer roller, the other transfer roller is grounded.

38. The apparatus as claimed in claim 30, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

39. The apparatus as claimed in claim 30, wherein said conductive roller comprises a roller formed of metal, resin or rubber and having a resistance as low as $10^9$ Ω·cm or below.

40. The apparatus as claimed in claim 39, wherein when said transfer roller and said conductive roller each comprise a roller formed of resin or rubber, said resin or said rubber forms a 0.1 mm to 5.0 mm thick layer.

41. The apparatus as claimed in claim 27, wherein said first and second image transferring means comprise transfer rollers whose circumferential surfaces are spaced by a distance of 5 mm or above, preferably 10 mm or above.

42. The apparatus as claimed in claim 27, wherein said first and second image transferring means each comprise a transfer roller formed of rubber and having a resistance as low as $10^9$Ω·cm or below.

43. The apparatus as claimed in claim 42, wherein when said transfer roller and said conductive roller each comprise a roller formed of resin or rubber, said resin or said rubber forms a 0.1 mm to 5.0 mm thick layer.

44. An image forming apparatus comprising:

an image carrier and a first and a second intermediate image transfer body, and configured to transfer a toner image from said image carrier to said second intermediate image transfer body via said first intermediate image transfer body beforehand and from said second intermediate image transfer body to one surface of a recording medium, and further configured to transfer a toner image; from said image carrier to said first intermediate image transfer body and from said first intermediate image transfer body to the other surface of said recording medium, first image transferring means disposed in said first intermediate image transfer body for transferring said toner image present on said first intermediate image transfer body to either one of said second intermediate image transfer body and said other surface of said recording medium, and second image transferring means disposed in said first intermediate image transfer body for transferring said toner image present on said second intermediate image transfer body to said one surface of said recording medium.

45. The apparatus as claimed in claim 44, wherein a portion of said apparatus including said second intermediate image transfer body is openable away from a body of said apparatus.

46. The apparatus as claimed in claim 44, wherein conductive rollers, respectively facing said first and second image transferring means, each are disposed in the intermediate image transfer body where the respectively faced image transferring means is not disposed and grounded or applied with a charge opposite in polarity to a charge applied to said first and second image transferring means.

47. The apparatus as claimed in claim 46, wherein said first and second image transferring means comprise transfer rollers, and wherein each of said transfer rollers and the conductive roller facing said transfer roller are pressed against each other via said first intermediate image transfer body and said second intermediate image transfer body while overlapping each other in a direction perpendicular to a direction in which said first intermediate image transfer body and said second intermediate image transfer body move in contact with each other.

48. The apparatus as claimed in claim 47, wherein said conductive roller is grounded or applied with a charge opposite in polarity to a charge applied to said first and second image transferring means, and wherein when one of said transfer rollers, facing each other, is used as a transfer roller, the other transfer roller is grounded.

49. The apparatus as claimed in claim 47, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

50. The apparatus as claimed in claim 47, wherein an angle between a line virtually connecting axes of said transfer roller and said conductive roller, facing each other, or axes of said transfer rollers, facing each other, and the direction in which said first intermediate image transfer body and said second intermediate image transfer body move in contact with each other lies in a range of 90±30°.

51. The apparatus as claimed in claim 47, wherein said conductive roller comprises a roller formed of metal, resin or rubber and having a resistance as low as $10^9$ Ω·cm or below.

52. The apparatus as claimed in claim 51, wherein when said transfer roller and said conductive roller each comprise a roller formed of resin or rubber, said resin or said rubber forms a 0.1 mm to 5.0 mm thick layer.

53. The apparatus as claimed in claim 46, wherein said conductive roller is grounded or applied with a charge opposite in polarity to a charge applied to said first and second image transferring means, and wherein when one of said transfer rollers, facing each other, is used as a transfer roller, the other transfer roller is grounded.

54. The apparatus as claimed in claim 46, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

55. The apparatus as claimed in claim 46, wherein said conductive roller comprises a roller formed of metal, resin or rubber and having a resistance as low as $10^9$ Ω·cm or below.

56. The apparatus as claimed in claim 55, wherein when said transfer roller and said conductive roller each comprise a roller formed of resin or rubber, said resin or said rubber forms a 0.1 mm to 5.0 mm thick layer.

57. The apparatus as claimed in claim 44, wherein said first and second image transferring means comprise transfer rollers whose circumferential surfaces are spaced by a distance of 5 mm or above, preferably 10 mm or above.

58. The apparatus as claimed in claim 44, wherein said first and second image transferring means each comprise a transfer roller formed of rubber and having a resistance as low as $10^9$ Ω·cm or below.

59. The apparatus as claimed in claim 58, wherein when said transfer roller and said conductive roller each comprise a roller formed of resin or rubber, said resin or said rubber forms a 0.1 mm to 5.0 mm thick layer.

60. An image forming apparatus comprising:

an image carrier and a first and a second intermediate image transfer body to each of which a toner image is transferred from said image carrier, and configured to transfer toner images to said first intermediate image transfer body and said second intermediate image transfer body to opposite sides of a recording sheet, image transferring means for transferring said toner images from said first intermediate image transfer body and said second intermediate image transfer body to said recording medium, said image transferring means being disposed in one of said first intermediate image transfer body and said second intermediate image transfer body, wherein facing rollers facing said image transferring means are disposed in the intermediate image transfer body where said image transferring means is not disposed.

61. The apparatus as claimed in claim 60, wherein conductive rollers, respectively facing said image transferring means, each is disposed in one of the first and second intermediate image transfer bodies and grounded or applied with a charge opposite in polarity to a charge applied to said image transferring means.

62. The apparatus as claimed in claim 61, wherein said image transferring means comprises transfer rollers, and wherein each of said transfer rollers and the conductive roller facing said transfer roller are pressed against each other via said first intermediate image transfer body and said second intermediate image transfer body while overlapping each other in a direction perpendicular to a direction in which said first intermediate image transfer body and said second intermediate image transfer body move in contact with each other.

63. The apparatus as claimed in claim 62, wherein said conductive roller is grounded or applied with a charge opposite in polarity to a charge applied to said image transferring means, and wherein when one of said transfer rollers, facing each other, is used as a transfer roller, the other transfer roller is grounded.

64. The apparatus as claimed in claim 62, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

65. The apparatus as claimed in claim 62, wherein an angle between a line virtually connecting axes of said transfer roller and said conductive roller, facing each other, or axes of said transfer rollers, facing each other, and the direction in which said first intermediate image transfer body and said second intermediate image transfer body move in contact with each other lies in a range of 90±30°.

66. The apparatus as claimed in claim 62, wherein said conductive roller comprises a roller formed of metal, resin or rubber and having a resistance as low as $10^9$ Ω·cm or below.

67. The apparatus as claimed in claim 66, wherein when said transfer roller and said conductive roller each comprise a roller formed of resin or rubber, said resin or said rubber forms a 0.1 mm to 5.0 mm thick layer.

68. The apparatus as claimed in claim 61, wherein said conductive roller is grounded or applied with a charge opposite in polarity to a charge applied to said image transferring means, and wherein when one of said transfer rollers, facing each other, is used as a transfer roller, the other transfer roller is grounded.

69. The apparatus as claimed in claim 61, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

70. The apparatus as claimed in claim 61, wherein said conductive roller comprises a roller formed of metal, resin or rubber and having a resistance as low as $10^9$ Ω·cm or below.

71. The apparatus as claimed in claim 70, wherein when said transfer roller and said conductive roller each comprise a roller formed of resin or rubber, said resin or said rubber forms a 0.1 mm to 5.0 mm thick layer.

72. The apparatus as claimed in claim 60, wherein said image transferring means comprises transfer rollers whose circumferential surfaces are spaced by a distance of 5 mm or above, preferably 10 mm or above.

73. The apparatus as claimed in claim 60, wherein said image transferring means comprises a transfer roller formed of rubber and having a resistance as low as $10^9$ Ω·cm or below.

74. The apparatus as claimed in claim 73, wherein when said transfer roller and said conductive roller each comprise a roller formed of resin or rubber, said resin or said rubber forms a 0.1 mm to 5.0 mm thick layer.

75. An image forming apparatus comprising:

an image carrier a first and a second intermediate image transfer body to each of which a toner image is transferred from said image carrier, and configured to transfer toner images to said first intermediate image transfer body and said second intermediate image transfer body to opposite sides of a recording sheet, image transferring means for transferring said toner images from said first intermediate image transfer body and said second intermediate image transfer body to said recording medium, said image transferring means being disposed in either said first intermediate image transfer body or said second intermediate image transfer body, wherein facing rollers facing said image transferring means are disposed in the intermediate image transfer body where said image transferring means is not disposed.

76. The apparatus as claimed in claim 75, wherein conductive rollers, respectively facing said image transferring means, each is disposed in one of the first and second intermediate image transfer bodies and grounded or applied with a charge opposite in polarity to a charge applied to said image transferring means.

77. The apparatus as claimed in claim 76, wherein said image transferring means comprises transfer rollers, and wherein each of said transfer rollers and the conductive roller facing said transfer roller are pressed against each other via said first intermediate image transfer body and said second intermediate image transfer body while overlapping each other in a direction perpendicular to a direction in which said first intermediate image transfer body and said second intermediate image transfer body move in contact with each other.

78. The apparatus as claimed in claim 77, wherein said conductive roller is grounded or applied with a charge opposite in polarity to a charge applied to said image transferring means, and wherein when one of said transfer rollers, facing each other, is used as a transfer roller, the other transfer roller is grounded.

79. The apparatus as claimed in claim 77, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

80. The apparatus as claimed in claim 77, wherein an angle between a line virtually connecting axes of said transfer roller and said conductive roller, facing each other, or axes of said transfer rollers, facing each other, and the direction in which said first intermediate image transfer body and said second intermediate image transfer body move in contact with each other lies in a range of 90±30°.

81. The apparatus as claimed in claim 77, wherein said conductive roller comprises a roller formed of metal, resin or rubber and having a resistance as low as $10^9$ Ω·cm or below.

82. The apparatus as claimed in claim 81, wherein when said transfer roller and said conductive roller each comprise a roller formed of resin or rubber, said resin or said rubber forms a 0.1 mm to 5.0 mm thick layer.

83. The apparatus as claimed in claim 76, wherein said conductive roller is grounded or applied with a charge opposite in polarity to a charge applied to said image transferring means, and wherein when one of said transfer rollers, facing each other, is used as a transfer roller, the other transfer roller is grounded.

84. The apparatus as claimed in claim 76, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

85. The apparatus as claimed in claim 76, wherein said conductive roller comprises a roller formed of metal, resin or rubber and having a resistance as low as $10^9$ Ω·cm or below.

86. The apparatus as claimed in claim 85, wherein when said transfer roller and said conductive roller each comprise a roller formed of resin or rubber, said resin or said rubber forms a 0.1 mm to 5.0 mm thick layer.

87. The apparatus as claimed in claim 75, wherein said image transferring means comprises transfer rollers whose circumferential surfaces are spaced by a distance of 5 mm or above, preferably 10 mm or above.

88. The apparatus as claimed in claim 75, wherein said image transferring means comprises a transfer roller formed of rubber and having a resistance as low as $10^9$ Ω·cm or below.

89. The apparatus as claimed in claim 88, further comprising a conductive roller and wherein when said transfer roller and said conductive roller each comprise a roller formed of resin or rubber, said resin or said rubber forms a 0.1 mm to 5.0 mm thick layer.

90. An image forming apparatus comprising:

an image carrier and a first and a second intermediate image transfer body, and configured to transfer a toner image from said image carrier to said second intermediate image transfer body via said first intermediate image transfer body beforehand and from said second intermediate image transfer body to one surface of a recording medium, and further configured to transfer a toner image from said image carrier to said first intermediate image transfer body and from said first intermediate image transfer body to the other surface of said recording medium, first image transferring means disposed in said second intermediate image transfer body for transferring said toner image present on said first intermediate image transfer body to said second intermediate image transfer body, second image transferring means disposed in said first intermediate image transfer body for transferring the toner image present on said first intermediate image transfer body to said other surface of said recording medium, and third image transferring means disposed in said first intermediate image transfer body for transferring said toner image present on said second intermediate image transfer body to said one surface of said recording medium.

91. The apparatus as claimed in claim 90, wherein said image transferring means comprise transfer rollers, wherein the transfer roller for transferring the toner image from said first intermediate image transfer body to said second intermediate image transfer body and the transfer roller for transferring said toner image from said second intermediate image transfer body to the one surface of the recording medium face each other, wherein a conductive roller, facing the transfer roller for transferring the toner image from said first intermediate image transfer body to the other surface of the recording medium, is disposed in the first intermediate image transfer body, and wherein said transfer rollers facing each other or said transfer roller and said conductive roller facing each other are pressed against each other via said first intermediate image transfer body and said second intermediate image transfer body while overlapping each other in a direction perpendicular to a direction in which said first intermediate image transfer body and said second intermediate image transfer body move in contact with each other.

92. The apparatus as claimed in claim 91, wherein said conductive roller is grounded or applied with a charge opposite in polarity to a charge applied to said first, second, and third image transferring means, and wherein when one of said transfer rollers, facing each other, is used as a transfer roller, the other transfer roller is grounded.

93. The apparatus as claimed in claim 91, wherein said transfer roller and said conductive roller disposed in a same intermediate image transfer body or said transfer rollers disposed in a same intermediate image transfer body have circumferential surfaces spaced from each other by a distance of 5 mm to 200 mm, preferably 10 mm to 100 mm.

94. The apparatus as claimed in claim 91, wherein an angle between a line virtually connecting axes of said transfer roller and said conductive roller, facing each other, or axes of said transfer rollers, facing each other, and the direction in which said first intermediate image transfer body and said second intermediate image transfer body move in contact with each other lies in a range of 90±30°.

95. The apparatus as claimed in claim 90, wherein said first, second, and third image transferring means each comprise a transfer roller formed of rubber and having a resistance as low as $10^9$ Ω·cm or below.

96. The apparatus as claimed in claim 95, wherein when said transfer roller and said conductive roller each comprise a roller formed of resin or rubber, said resin or said rubber forms a 0.1 mm to 5.0 mm thick layer.

* * * * *